US011439559B2

(12) United States Patent
Jenkins et al.

(10) Patent No.: US 11,439,559 B2
(45) Date of Patent: Sep. 13, 2022

(54) BODILY REMAINS DECOMPOSITION

(71) Applicant: Verde Products Inc., Wildwood, MO (US)

(72) Inventors: Robert L. Jenkins, Wildwood, MO (US); Annette Jenkins, Wildwood, MO (US)

(73) Assignee: Verde Products Inc., Wildwood, MO (US)

( * ) Notice: Subject to any disclaimer, the term of this patent is extended or adjusted under 35 U.S.C. 154(b) by 260 days.

(21) Appl. No.: 16/515,846

(22) Filed: Jul. 18, 2019

(65) Prior Publication Data

US 2020/0022862 A1 Jan. 23, 2020

Related U.S. Application Data

(60) Provisional application No. 62/700,083, filed on Jul. 18, 2018.

(51) Int. Cl.
*A61G 17/00* (2006.01)
*A61G 17/04* (2006.01)

(52) U.S. Cl.
CPC ..... *A61G 17/00* (2013.01); *A61G 17/048* (2016.11)

(58) Field of Classification Search
CPC ..... A61G 17/00; A61G 17/04; A61G 99/00; A61G 17/048; A61G 2203/46; B09B 3/00; B09B 3/0075; B09B 3/0083; B09B 5/00; A62D 3/36
USPC ..... 27/2; 241/1, 301; 588/318
See application file for complete search history.

(56) References Cited

U.S. PATENT DOCUMENTS 1,510,972 A 10/1924 Beam
5,332,532 A * 7/1994 Kaye ..... G21F 9/28 588/16
6,472,580 B2 * 10/2002 Kaye ..... A61L 11/00 588/317
8,066,953 B2 * 11/2011 Muth ..... B01J 19/0066 422/198

(Continued)

FOREIGN PATENT DOCUMENTS

DE 19853940 5/2000
DE 10116113 10/2002

(Continued)

OTHER PUBLICATIONS

European Office Action in European Application No. 19187089.8, dated Jun. 7, 2021, 4 pages.

(Continued)

*Primary Examiner* — William L Miller
(74) *Attorney, Agent, or Firm* — Stinson LLP

(57) ABSTRACT

A storage pod for containing a body and decomposition material for decomposing the body in the storage pod includes an elongate housing having opposite ends. The housing contains the body and the decomposition material. The housing defines an interior configured to receive the body and decomposition material, at least one air vent in fluid communication with the interior so that air can enter the interior through the at least one air vent when the housing is closed, and a product inlet in fluid communication with the interior so that decomposition material can enter the interior through the product inlet when the housing is closed.

15 Claims, 17 Drawing Sheets

(56) References Cited

U.S. PATENT DOCUMENTS

| | | | | |
|---|---|---|---|---|
| 8,235,319 | B2 * | 8/2012 | Sullivan | B09B 3/0075 241/301 |
| 8,931,147 | B2 * | 1/2015 | Sullivan | B09B 3/0075 27/2 |
| 9,018,433 | B2 * | 4/2015 | Wilson | B01J 19/24 588/314 |
| 9,168,573 | B2 * | 10/2015 | Hojaji | C03C 14/00 |
| 9,492,697 | B2 * | 11/2016 | Wilson | B01J 19/28 |
| 10,822,288 | B2 | 11/2020 | Jenkins et al. | |
| 10,835,773 | B2 * | 11/2020 | Mason | B09B 5/00 |
| 2005/0120526 | A1 * | 6/2005 | Nihipali | A01N 1/00 27/21.1 |
| 2006/0222574 | A1 * | 10/2006 | Kaye | B09B 3/0083 422/184.1 |
| 2009/0311766 | A1 * | 12/2009 | Muth | B01J 19/18 435/173.1 |
| 2010/0213292 | A1 * | 8/2010 | Sullivan | B09B 3/00 241/1 |
| 2013/0295624 | A1 * | 11/2013 | Medoff | C12P 7/52 435/134 |
| 2014/0013554 | A1 * | 1/2014 | Hojaji | B09B 5/00 27/1 |
| 2019/0099313 | A1 | 4/2019 | Jenkins et al. | |
| 2020/0207675 | A1 * | 7/2020 | Bernstein | A61G 17/004 |

FOREIGN PATENT DOCUMENTS

| | | |
|---|---|---|
| EP | 1348682 | 10/2003 |
| EP | 1354644 | 10/2003 |
| JP | H08182714 | 7/1996 |
| WO | WO2019023343 | 1/2019 |

OTHER PUBLICATIONS

Extended European Search Report in European Application No. 19187089.8, dated Oct. 17, 2019, 8 pages.

* cited by examiner

BODILY REMAINS DECOMPOSITION

CROSS-REFERENCE TO RELATED APPLICATIONS

This application claims priority to U.S. Provisional Application No. 62/700,083, filed Jul. 18, 2018, the entirety of which is hereby incorporated by reference.

FIELD

The present invention generally relates to the decomposition of bodily remains. In particular, the present invention relates to a storage pod for containing a body and decomposition material for decomposing the body.

BACKGROUND

Memorializing of the deceased is typically done using cremation or non-cremation burial, with or without the body contained within a casket or other enclosure. The present disclosure relates to an alternative to the more traditional ways of memorializing the deceased.

SUMMARY

In one aspect, a storage pod for containing a body and decomposition material for decomposing the body in the storage pod comprises an elongate housing having opposite ends. The housing is configured to contain the body and the decomposition material. The housing defines an interior configured to receive the body and decomposition material. The housing also defines at least one air vent in fluid communication with the interior so that air can enter the interior through the at least one air vent when the housing is closed. The housing also defines a product inlet in fluid communication with the interior so that decomposition material can enter the interior through the product inlet when the housing is closed.

In another aspect, a method of decomposing a body comprises placing the body into an interior of a housing, filling the interior with a decomposition material, and waiting for the body to decompose. In addition, during the waiting, air enters the interior through at least one air vent of the housing.

Other objects and features of the prevent invention will be in part apparent and in part pointed out hereinafter.

BRIEF DESCRIPTION OF THE DRAWINGS

Corresponding reference characters indicate corresponding parts throughout the drawings.

DESCRIPTION OF THE PREFERRED EMBODIMENTS

Figure 1:
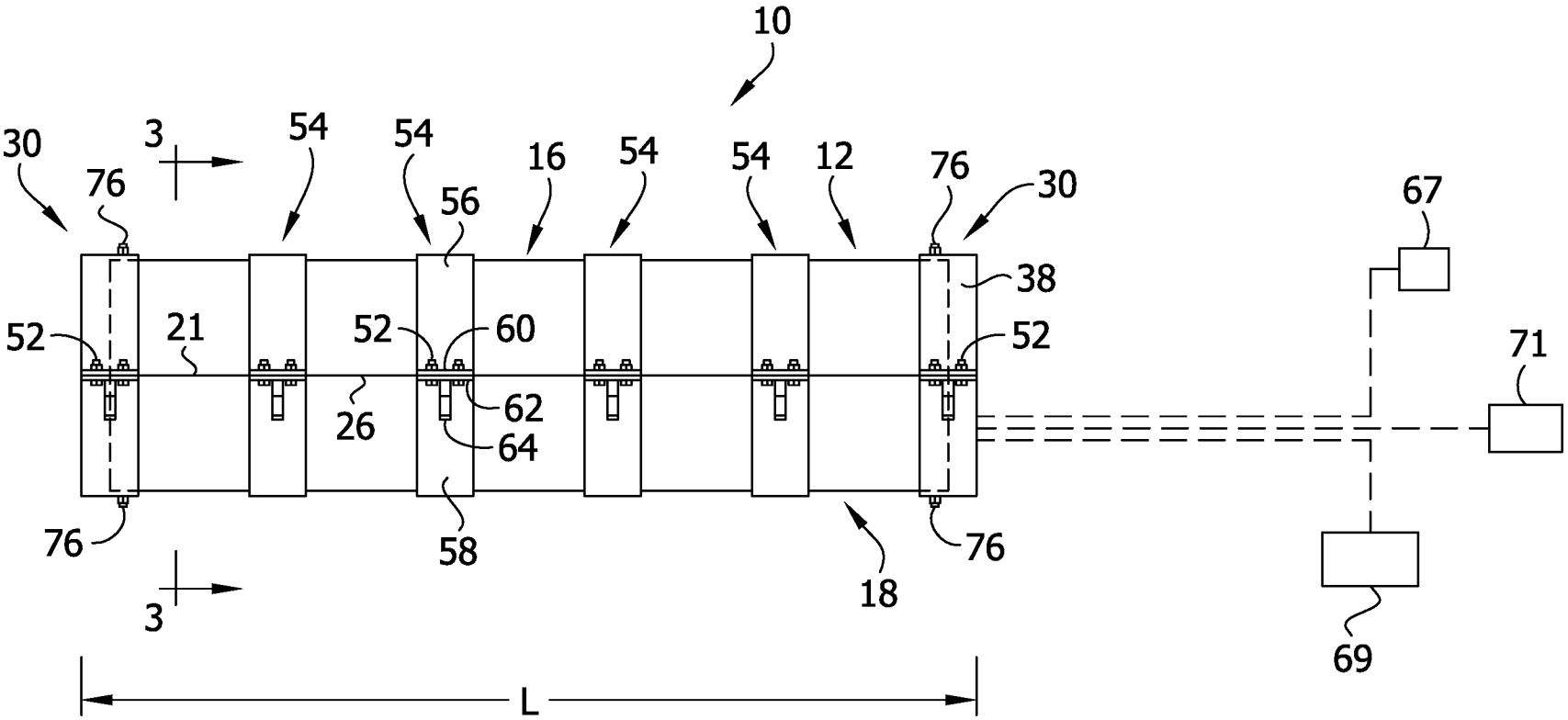
FIG. 1 is a side view of a storage pod according to one embodiment of the present disclosure.
Figure 2:
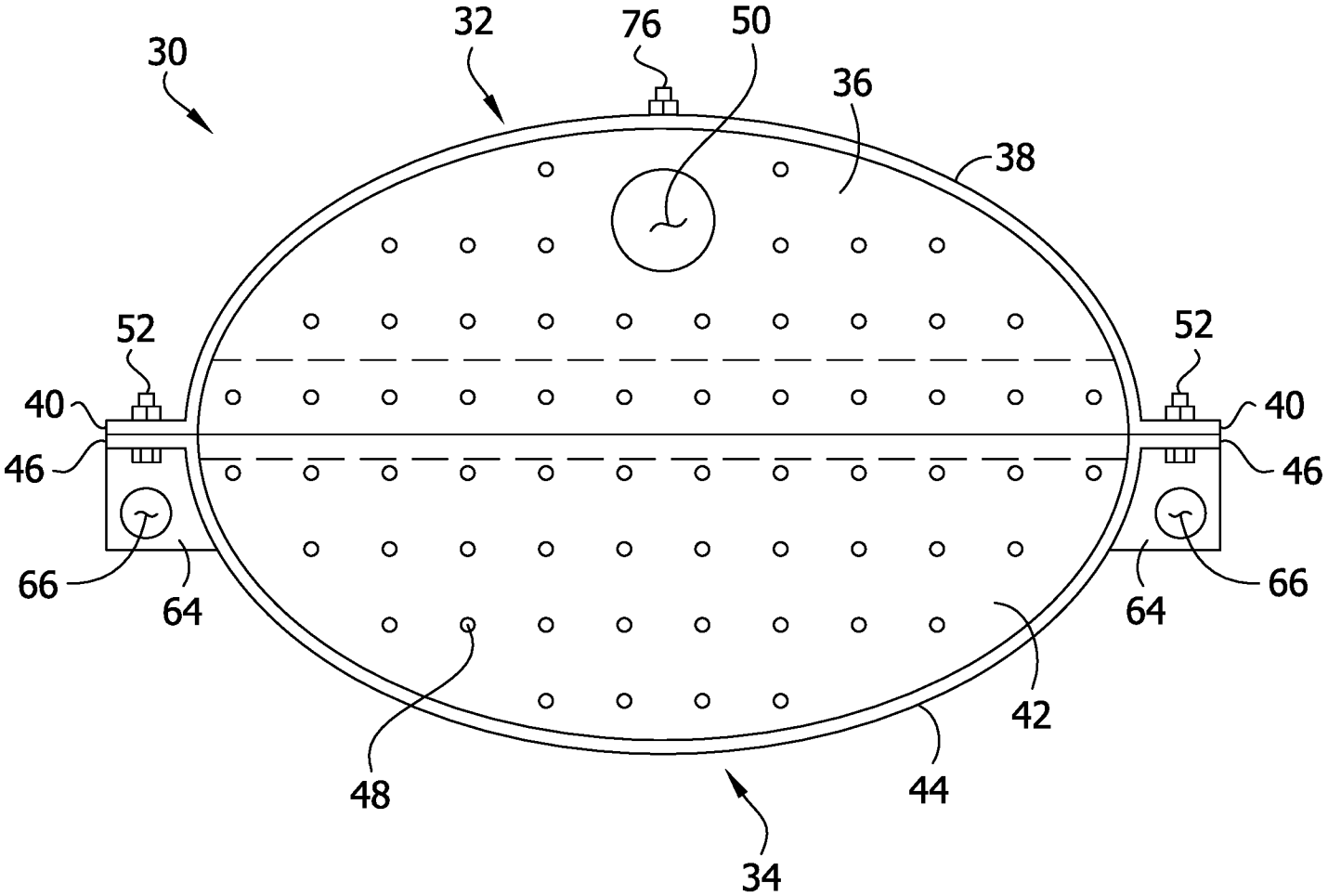
FIG. 2 is a front view of an end cap of the storage pod.
Figure 3:
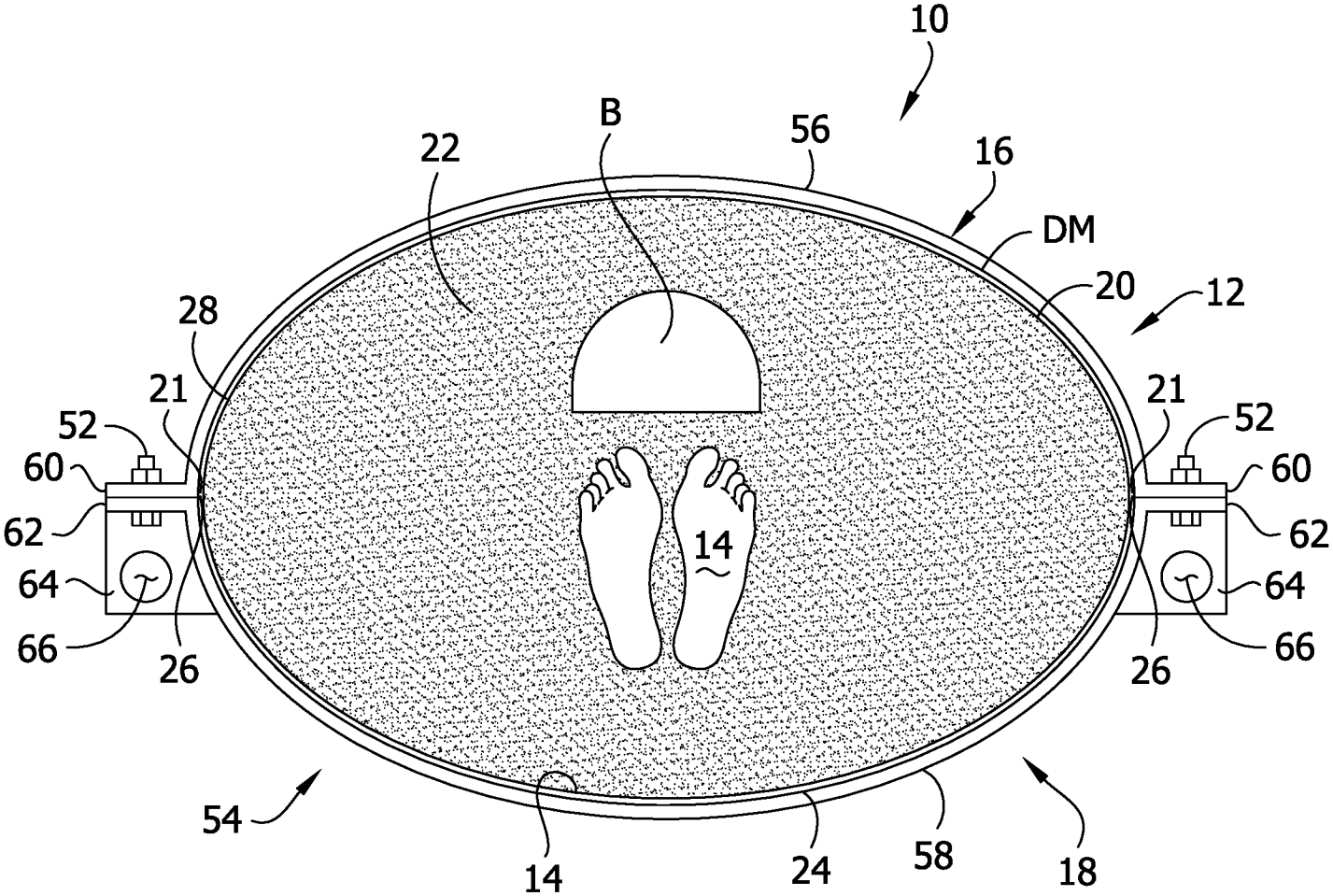
FIG. 3 is a cross-section of the storage pod taken through line 3-3 of FIG. 1 holding a body and filled with decomposition material.

Referring to FIGS. 1-3, a storage pod according to one embodiment of the present disclosure is generally indicated at 10. The storage pod 10 is configured to hold and store a body B (e.g., the deceased) and decomposition material DM so that the body can be decomposed by the decomposition material (e.g., the decomposition material facilitates the decomposition of the body). As discussed in more detail below, at least some of the decomposition material DM is added to the storage pod 10 before the body B is placed in the storage pod, and then a remainder of the decomposition material is added to the storage pod to cover the body and fill the pod. Alternatively, the body B is placed inside the storage pod 10 and then the storage pod is filled with decomposition material DM. The decomposition material DM surrounds the body B and decomposes the body over a period of time (typically, 24 to 32 months). The decomposition material DM is configured to decompose the body B (e.g., break down the bodily remains). One example of a suitable decomposition material DM is described in U.S. patent application Ser. No. 15/723,859, herein incorporated by reference in its entirety. It is understood the use of other types of decomposition materials DM, or combinations thereof, are within the scope of the present disclosure.

The storage pod 10 includes an elongate housing 12 with opposite ends. The housing 12 defines an interior 14 configured to receive the body B and decomposition material DM (FIG. 3). The housing 12 has a length L extending between the opposite ends that is greater than the length of the body B (e.g., height of the deceased) so that the body may be laid down in the interior 14 of the housing. In the preferred embodiment, the housing 12 has a length L of about 8 ft. (2.4 m). The housing 12 includes a top portion 16 and a bottom portion 18. The top and bottom portions 16, 18 partially define the interior 14 (broadly, at least partially define the interior). The top and bottom portions 16, 18 are releasably connected to one another to provide access to the interior. In the illustrated embodiment, the housing 12 has a generally cylindrical shape with a generally elliptical shape in cross-section (FIG. 3). However, other shapes of the housing 12 are within the scope of the present disclosure. The top portion 16 defines the upper half of the housing 12 and the bottom portion 18 defines the lower half of the housing. The top portion 16 includes a generally semi-cylindrical shaped wall 20 with opposite lower edge margins 21. The wall 20 has a generally concave lower surface that defines an upper section of the interior 14. The bottom portion 18 includes a generally semi-cylindrical shaped wall 24 with opposite upper edge margins 26. The wall 24 has a generally concave upper surface that defines a lower section of the interior 14. The bottom portion 18 includes flanges 28 connected to the concave upper surface of the wall 24 adjacent each respective upper edge margin 26 and extending upward therefrom. Each flange 28 is configured to overlie and engage a portion of the generally concave lower surface of the wall 20 adjacent one of the lower edge margins 21 of the top portion 16. Accordingly, each flange 28 is shaped (e.g., curved) to correspond to the shape of the top portion 16. When the top and bottom portions 16, 18 are connected together, the each lower edge margin 21 of the top portion 16 engages with the corresponding upper edge margin 26 of the bottom portion 18 and the flanges 28 overly and engage the generally concave lower surface of the top portion to create a seal that prevents the decomposition material DM from passing there-through. As used throughout the present disclosure with respect to the storage pod, the terms defining relative locations and positions of structures and components, including but not limited to the terms "top," "bottom," "side," "upper," and "lower," are meant to provide a point of reference for such components and structures as shown in the drawings, with the understanding that the respective relative locations of such components and structures will depend on the orientation of the storage pod in use.

The housing 12 also includes an end cap 30 at each end of the housing. The end caps 30 define longitudinal ends of the housing. In this manner, the top portion 16, bottom portion 18, and end caps 30 of the housing 12 define the interior 14. Each end cap 30 is releasably connected to the top and bottom portions 16, 18. The end caps 30 are substantially identical in structure and function (except as otherwise mentioned), and therefore, reference will be made to one end cap for ease of description with the understanding that the following description can apply to both end caps. The end caps 30 include an upper portion 32 and a lower portion 34 that are releasably connected to one another. The upper portion 32 of the end cap 30 includes an axially facing upper end wall 36 generally sized and shaped to conform to the cross-sectional shape of the top portion 16 and an upper clamp ring 38 extending around the upper end wall. The upper clamp ring 38 is sized and shaped to overly and engage an outer surface of the top portion 16. Opposite connection flanges 40 extend generally horizontally outward (e.g., radially outward) in opposite directions from opposite ends of the upper clamp ring 38. The lower portion 34 of the end cap 30 includes an axially facing lower end wall 42 generally sized and shaped to conform to the cross-sectional shape of the bottom portion 18 and a lower clamp ring 44 extending around the lower end wall. The lower clamp ring 44 is sized and shaped to overly and engage an outer surface of the bottom portion 18. Opposite connection flanges 46 extend generally horizontally outward (e.g., radially outward) in opposite directions from opposite ends of the lower clamp ring 44. Each connection flange 40, 46 is configured to receive at least one fastener 52 therein (e.g., define at least one opening for the fastener) to connect the upper and lower portions 32, 34 of the end cap 30 together. In the illustrated embodiment, two fasteners 52 are used. In one embodiment, the end cap 30 does not comprise two separate portions 32, 34 but, instead, is a single component.

Referring to FIG. 2, the upper and lower end walls 36, 42 of at least one of the end caps 30 define a plurality (broadly, at least one) of individual air vents 48 (broadly, an air inlet and/or an air outlet). As explained in more detail below, each air vent 48 allows air to flow freely into and out of the interior 14 through the housing 12 when the housing is closed. Each air vent 48 is a small hole or opening extending through either the upper or lower end wall 36, 42. In the illustrated embodiment, the individual air vents 48 are arranged in a rectangular grid pattern on the upper and lower end walls 36, 42. In other embodiments, the air vents 48 may have other shapes and arrangements. In the one embodiment, both end caps 30 define respective air vents 48, however, in other embodiments only one end cap may define the air vents. Still further, in other embodiments, the air vents 48 may be defined by other components of the housing 12, such as the top portion 16 and/or bottom portion 18. In one embodiment, the storage pod 10 includes a controlled air flow system that delivers a supply of air to the interior 14. In this embodiment, the walls 20, 24 of the top and bottom portions 16, 18 may include multiple layers with at least one of the layers defining one or more passageways to deliver air supplied by the controlled air flow system to the interior 14 through perforations in the upper and lower concave surfaces of the walls. In this embodiment, the storage pod 10 may not include air vents 48 that permit air to freely flow into and out of the storage pod. In this case, the storage pod 10 will include a gas relief valve (not shown), preferably with a filtration unit, to allow gasses that build up in the interior 14 during the decomposition process to escape and prevent an explosive pressure from building up in the storage pod.

The upper end wall 36 of at least one of the end caps 30 also defines a product inlet 50 (broadly, at least one product inlet). As explained in more detail below, the product inlet facilitates the filling of the interior 14 of the housing 12 with decomposition material DM when the housing is closed. The product inlet 50 is a hole or opening that extends through the upper end wall 36. In one embodiment, the product inlet 50 is a circular shaped opening with a diameter corresponding to the diameter of a hose used to blow in the decomposition material DM into the interior 14 such that the end of the hose can be inserted into the product inlet. It is understood the product inlet 50 may have other shapes and configurations. In one embodiment, both end caps 30 define respective product inlets 50, however in other embodiments only one end cap may define a product inlet. A lid (not shown) may be provided and configured to close the product inlet 50.

Referring to FIGS. 1 and 2, the end cap 30 is configured to be mounted onto the top and bottom portions 16, 18 at one end thereof. When the upper and lower portions 32, 34 of the end cap 30 are connected together, the shape of the end cap corresponds to the cross-sectional shape of the top and bottom portions 16, 18 (e.g., the end cap has a generally elliptical shape). To connect the upper and lower portions 32, 34 of the end cap 30, the upper and lower portions are positioned such that the connection flanges 40, 46 of each portion overlap and engage each other and, then, the fastener 52 is inserted through the connection flanges 40, 46 to connect the portions. In the illustrated embodiment, the fasteners 52 are bolts with nuts threaded thereon to secure the connection flanges 40, 46. It is understood that other ways of connecting the upper and lower portions 32, 34 of the end cap 30 are within the scope of the present disclosure. When the upper and lower portions 32, 34 of the end cap 30 are coupled the upper and lower end walls 36, 42 engage each other to form a seal that prevents the decomposition material DM from passing there-through. Moreover, the ends of the upper and lower clamp rings 38, 44 engage each other to form a generally continuous clamp ring that is configured to extend circumferentially around the outside of the top and bottom portions 16, 18. In one embodiment, the end cap 30 does not comprise two separate components but, instead, is a single component (e.g., piece of material or a single component formed from different materials).

Referring to FIG. 1, the housing 12 of the storage pod 10 includes a plurality of releasable clamps 54 configured to secure the top and bottom portions 16, 18 together. In the illustrated embodiment, the housing 12 includes four clamps 54 evenly spaced between the end caps 30 at the opposite ends of the housing. Each clamp 54 extends circumferentially around the top and bottom portions 16, 18 to securely couple the top and bottom portions together. The clamps 54 include an upper clamp ring 56 and a lower clamp ring 58. The upper clamp ring 56 is sized and shaped to overly and engage the outside surface of the top portion 16. Opposite connection flanges 60 extend generally horizontally outward (e.g., radially outward) in opposite directions from opposite ends of the upper clamp ring 56. The lower clamp ring 58 is sized and shaped to overly and engage the outside surface of the bottom portion 18. Opposite connection flanges 62 extend generally horizontally outward (e.g., radially outward) in opposite directions from opposite ends of the lower clamp ring 58. Each connection flange 60, 62 is configured to receive at least one fastener 52 therein (e.g., define at least one opening) to connect the upper and lower clamp rings 56, 58 of the clamp 54 together. In the illustrated embodiment, two fasteners 52 are used. The fastener 52 used to secure the upper and lower clamp rings 56, 58 may be the same as the fastener used to secure the upper and lower portions 32, 34 of the end caps 30 together or may be different. Thus, the clamps 54 are similar in structure (except for the end walls) to the end caps 30. Other ways of securing the upper and lower clamp rings 56, 58 are within the scope of the present disclosure. In the illustrated embodiment, the upper and lower clamp rings 56, 58 are formed from a single strip of metal cut and bent into shape. Other configurations of the clamps 54 are within the scope of the present disclosure.

In the illustrated embodiment the end caps 30 and clamps 54 include transport tabs 64 configured to facilitate the transport of the storage pod 10. The transport tabs 64 are connected to the lower clamp ring 44 of the end caps 30 and the lower clamp ring 58 of the clamps 54. In particular, each lower clamp ring 44, 58 includes two transport tabs 64 at each end that extend therefrom and are connected to one of the connection flanges 46, 62. Each transport tab 64 defines a circular opening 66 configured to receive a cylindrical rod (not shown) therein. As shown in FIGS. 1 and 3, when the end caps 30 and clamps 54 are connected to the top and bottom portions 16, 18, the openings 66 defined by the transport tabs 64 are aligned on each side of the housing 12 such that two rods can be inserted through the openings 66 on either side of the housing to form handles from which several persons can grab and transport the housing. In other embodiments, the openings 66 may have other shapes to correspond to other rod shapes. In still other embodiments, the housing 12 may have one or more handles of a different configuration. For example, one or more handles of the housing 12 may be integrally formed with the end caps 30, the clamps 54 and/or the bottom portion 18.

The decomposition material DM induces the growth of bacteria to break down and decompose the body B in the storage pod 10. To facilitate the growth of the bacteria in the interior 14 of the storage pod 10, the storage pod may include a temperature monitor unit 67 (FIG. 1), a moisture control unit 69, and/or an air flow control unit 71 in order to maintain optimal conditions in the interior of the storage pod for the bacteria during the decomposition process (e.g., the period of time for the body B to decompose). The temperature monitor unit 67 is configured to monitor the temperature in the interior 14. In the preferred embodiment, the temperature monitor unit 67 includes at least one temperature sensor configured to sense the temperature of the interior 14 of the housing 12, a display configured to present information to the user (such as the current temperature of the interior), and a temperature module operatively connected to the temperature sensor and the display and configured (e.g., programmed) to receive signals from the temperature sensor (indicative of the temperature in the interior) and send signals to the display (based off of signals from the temperature sensor).

The moisture control unit 69 is configured to regulate the amount of moisture (e.g., water) in the interior 14. The moisture control unit 69 is configured to maintain the moisture content in the interior 14 within a preferred range of the bacteria growing therein. In the preferred embodiment, the moisture control unit 69 includes a moisture delivery system (e.g., fluid vents, ducts, manifold, fluid inlet, fluid supply system, etc.) in fluid communication with the interior 14 and configured to deliver moisture to the interior, at least one moisture sensor configured to sense the moisture content of the interior, and a moisture controller (which may be integral with the temperature module) operatively connected to the moisture sensor and moisture delivery system and configured (e.g., programmed) to receive signals from the moisture sensor (indicative of the moisture content in the interior) and send signals to the moisture delivery system (based off of signals from the moisture sensor) to regulate the amount of moisture in the interior. The moisture delivery system may include one or more moisture outlets (e.g., fluid vents) fluidly connected to the interior 14 of the housing, a moisture source (e.g., fluid supply system), one or more moisture conduits (e.g., manifolds, ducts) fluidly connecting the moisture source to the one or more moisture outlets, and one or more selectively actuatable valves configured to control the flow of moisture through the one or more moisture conduits. In this embodiment, the moisture controller controls the selectively actuatable valves to regulate the amount of moisture delivered to the interior 14 of the housing from the moisture source. The moisture source can be a reservoir, a utility supply line (e.g., a water main), or any other suitable device. The moisture controller may include a user interface configured to receive input from the user (such as the moisture range for the interior 14) and/or a display configured to present information to the user (such as the current moisture setting and/or the current moisture content of the interior).

If the storage pod 10 includes an air flow system (not shown), the air flow control unit 71 can also be provided to regulate the amount of air delivered by the air flow system (e.g., air vents, ducts, manifold, air inlet, air supply system, etc.) to the interior 14. In the preferred embodiment, the air flow control unit 71 includes an air flow controller (which may be integral with the temperature module and/or moisture controller) operatively connected to the air flow system, the temperature module, and the moisture controller and configured (e.g., programmed) to receive signals from the temperature module and moisture controller (indicative of the temperature and moisture content in the interior) and send signals to the air flow system (based off of signals from the temperature module and moisture controller) to regulate the amount of air supplied to the interior. The air flow controller may also send signals to the moisture controller. By controlling the amount of air and/or moisture supplied to the interior 14 of the storage pod (using the air flow control unit 71 and/or moisture control unit 69 in communication with the temperature monitor unit 67) the temperature in the interior can be controlled. In the preferred embodiment, the temperature in the interior 14 is maintained between about 60° F. (15° C.) and about 90° F. (32° C.)—the optimal temperature range for the bacteria to grow and decompose the body B. The temperature of the interior 14 can be maintained in other temperature ranges. For example, the temperature of the interior 14 may be maintained in a warmer or cooler temperature range to correspond to a warmer or cooler environment preferred by the particular bacteria growing therein. It is understood that different decomposition materials DM will induce the growth of different types of bacteria, each type of bacterial having different preferred environmental conditions (e.g. temperature, air, moisture, etc.) in which to grow.

Figure 4:
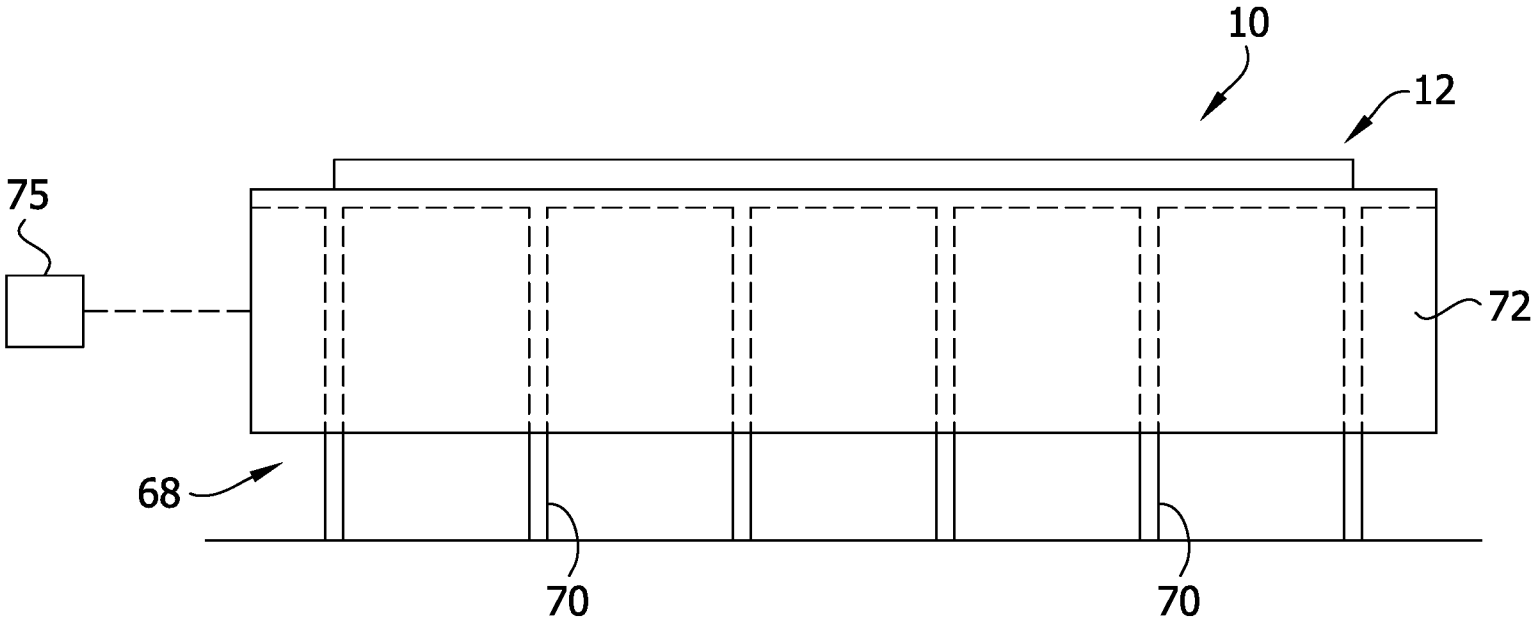
FIG. 4 is a side view of the storage pod supported by a frame with a top portion of the storage pod removed.
Figure 5:
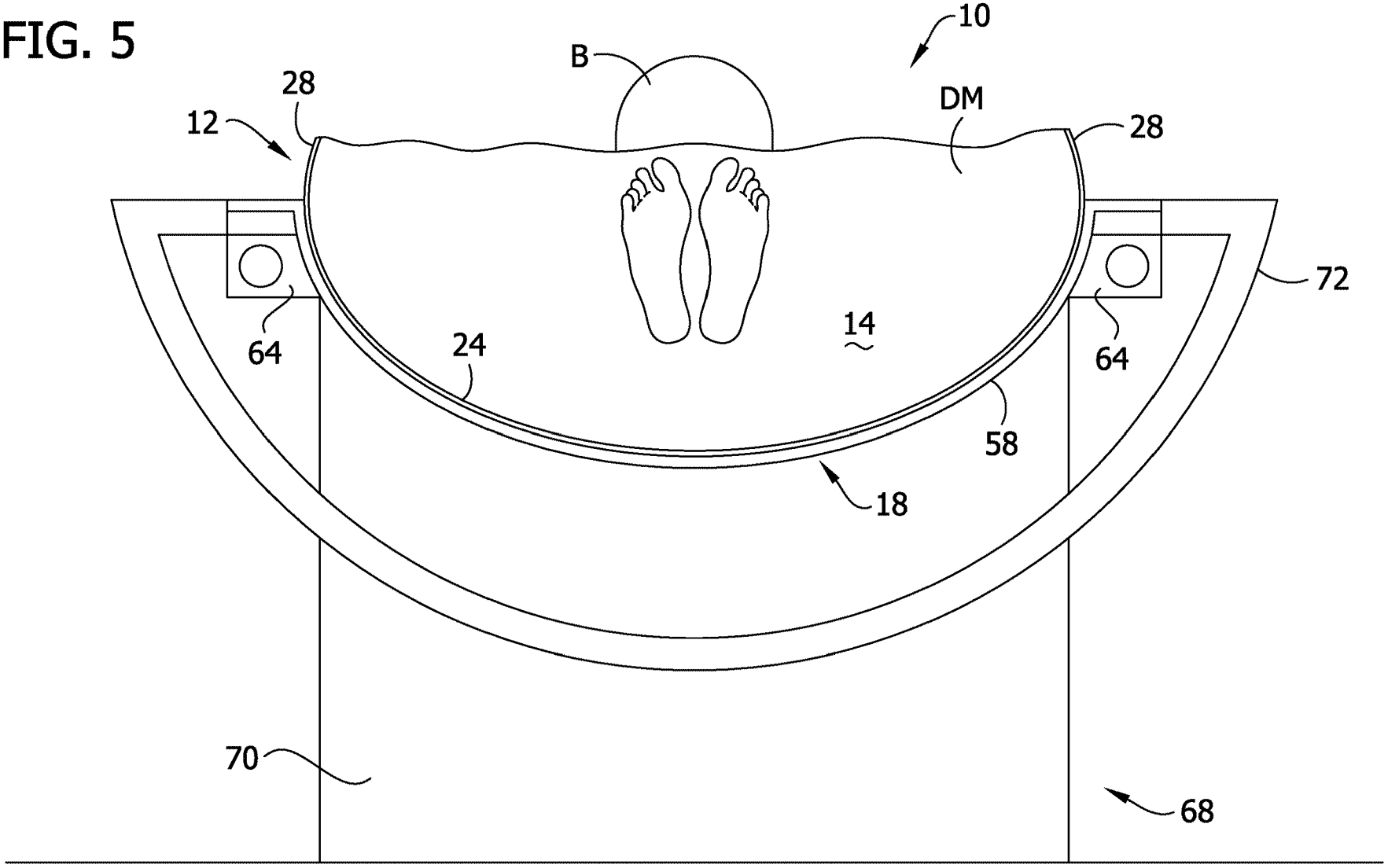
FIG. 5 is a front view of the storage pod of FIG. 4 holding the body and filled with decomposition material.
Figure 7:
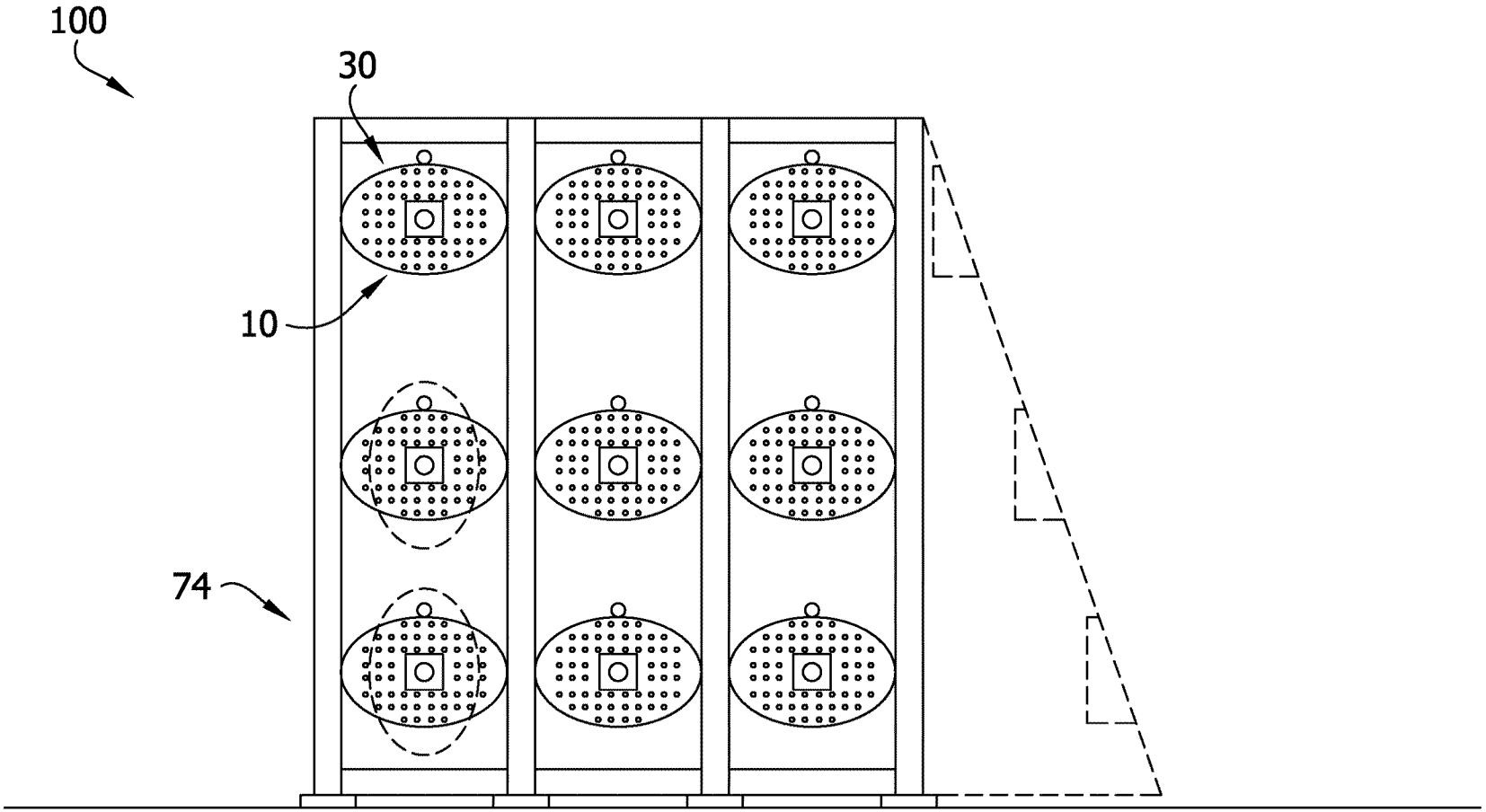
FIG. 7 is an elevation view of the plurality of storage pods housed in the mausoleum of FIG. 6.

Referring to FIGS. 4 and 5, a frame 68 is configured to support the storage pod 10. The frame 68 is configured to receive and support the bottom portion 18 of the housing 12. In the illustrated embodiment, the frame 68 is in the form of a viewing table. The viewing table has support legs 70 and an aesthetically appealing enclosure 72 configured to receive the storage pod 10 for display. The enclosure 72 may be made from hardwood, fiberglass, or some other rigid material. Other configurations of the frame 68 are within the scope of the present disclosure. For example, as shown in FIG. 7, a frame 74 is configured to support a plurality of storage pods 10 (broadly, at least one storage pod). In the illustrated embodiment, frame 74 supports nine storage pods 10 in a three by three stacked arrangement. Accordingly, as shown in FIGS. 4 and 7, the storage pod 10 of the present disclosure may be used as a standalone device or combined with other storage pods.

The storage pod 10 may also include a prime mover 75 (FIG. 4) operatively connected to or built into the housing 12 to agitate (e.g., mix) the body B and decomposition material DM in the interior 14 during the decomposition process. By agitating the body B and decomposition material DM in the storage pod 10, the amount of time for the body to decompose can be reduced. In one embodiment, the prime mover 75 is a vibrator (e.g., agitator) configured to vibrate (e.g. shake or agitate) the storage pod 10. The vibrator can be attached to or built into the housing 12 and configured to vibrate the housing to agitate the body B and decomposition material DM therein. In another embodiment, the prime mover 75 is a driver (such as, but not limited to, an electric motor, hand crank, etc.) operatively coupled to the storage pod 10 and configured to move the storage pod relative to the frame. In one embodiment, the driver 75 is configured to rotate the housing 12 about a rotational axis thereof (the rotational axis extends between the opposite ends of the housing). The driver may rotate the housing 180° about the rotational axis or 90° to either side (clockwise and counter-clockwise) of a rest position of the storage pod. For example, as shown in FIG. 7, the storage pods 10 are generally shown in the rest position in the frame 74 with the broken lines over the lower two storage pods 10 in the left hand stack showing the orientation of the storage pod as it would be when rotated 90° (either clockwise or counter-clockwise) by the driver. In other embodiments, the driver may rotate the storage pod 10 in other manners and configurations. In one embodiment, the prime mover 75 includes both the vibrator and the driver coupled to the storage pod 10 and configured to agitate the body B and decomposition material DM individually and/or simultaneously. In one embodiment, a prime mover controller (which may be integral with the other controllers described herein) is configured to (e.g., programmed) to operate the prime mover 75, which may be intermittently (e.g., at random or set intervals) or continuously during the decomposition process.

Figure 6:
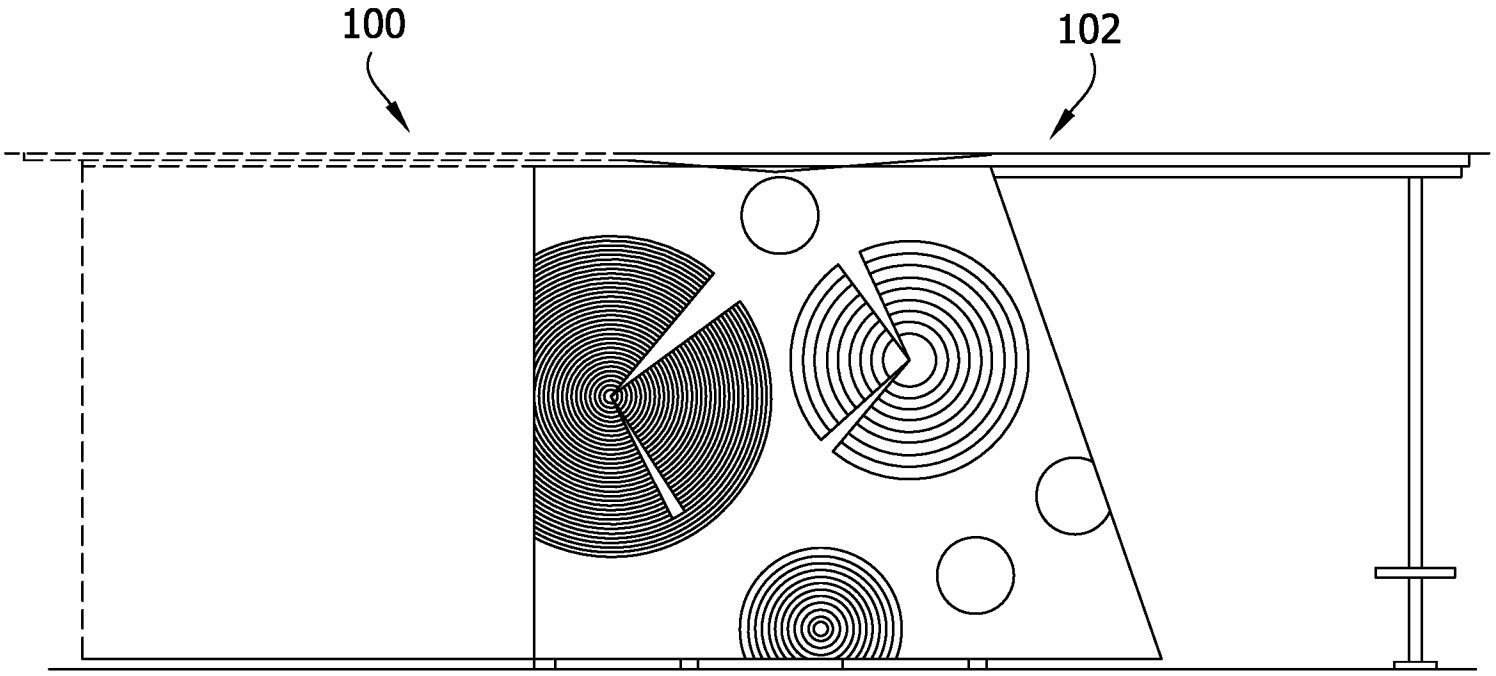
FIG. 6 is an illustration of a mausoleum that houses a plurality of storage pods of FIG. 1 according to one embodiment of the present disclosure.
Figure 8:
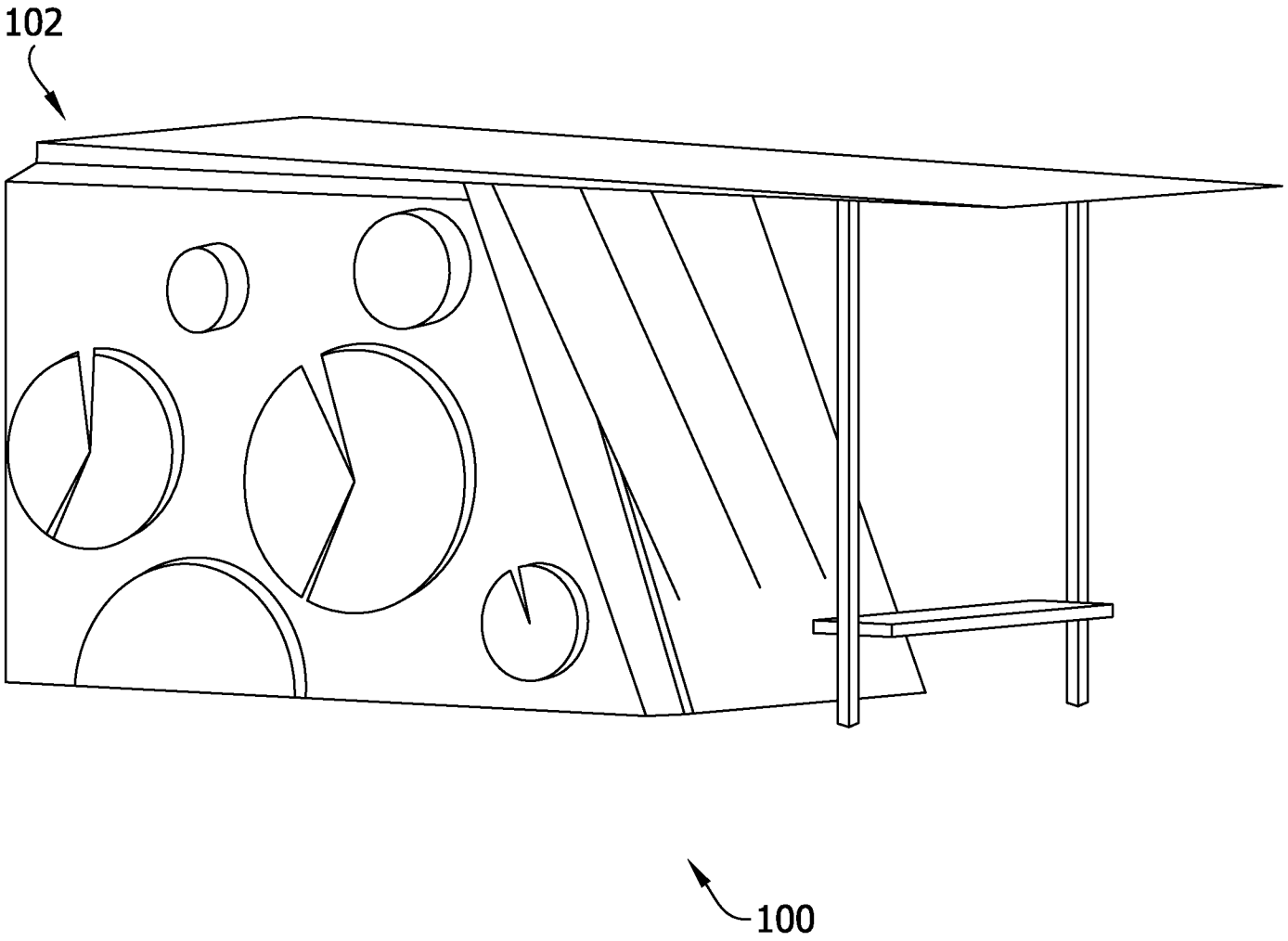
FIG. 8 is another illustration of the mausoleum of FIG. 6.

Referring to FIGS. 6-8, a mausoleum (e.g. a structure) for holding one or more storage pods 10 during the decomposition process is shown generally at 100. The storage pod 10 of the present disclosure could also be housed in a funeral home, cemetery, or other facility. The mausoleum 100 includes a decorative facade which, in this embodiment, includes cross-sectional pieces of tree trunks. In other embodiments, other decorative features may be included on the facade. For example, in one embodiment, the facade includes the names of the deceased currently in the storage pods 10 contained within the mausoleum 100. As shown in FIG. 7, the mausoleum 100 houses the frame 74 which supports nine storage pods 10. The frame 74 is a steel structure and additional sections (e.g., rows and/or columns) can be easily added or removed to the frame 74 to accommodate the desired number of storage pods 10 (e.g., the frame can be configured to support any number of storage pods). For example, the frame 74 can be configured to support more or less than nine storage pods 10. In the preferred embodiment, the mausoleum 100 supports one or more solar cells (not shown) on a roof 102 of the mausoleum. The one or more solar cells (broadly, at least one solar cell) are configured to power the prime mover 75 and any other components (such as the controllers or sensors) during the decomposition process. In one embodiment, the solar cells can be configured to power the electrical components of the storage pod 10 (prime mover, controllers, sensors, valves, etc.) directly. In another embodiment, the solar cells are configured to charge an electrical storage device (e.g., batteries) or to provide power to an electrical grid, either of which in turn can then power the electrical components of the storage pod 10. In other embodiments, the mausoleum 100 does not include a source of solar power and the electricity required to power the electrical components of the storage pod 10 is supplied by the electrical grid.

The mausoleum 100 may include a rain water collector and a reservoir (not shown) fluidly connected to the rain water collector and configured to store the rain water captured by the rain water collector. The reservoir can be fluidly connected to each interior 14 of the one or more storage pods 10 in the mausoleum. Accordingly, the rain water stored in the reservoir (e.g., the moisture source) can then be directed into the interior 14 of each storage pod 10. In the illustrated embodiment, the roof 102 is sloped to function as the rain water collector (FIG. 6). As rain water hits the roof 102, the slope of the roof funnels the rain water into the reservoir. It is understood that one or more fluid conduits may fluidly connect the roof 102 to the reservoir and the reservoir to the interior 14 of each storage pod 10. The fluid conduit can be a hose, a pipe, or any other suitable device. In one embodiment, a pump (not shown) may be fluidly connected to the reservoir to direct the rain water into the storage pods. The moisture controller can be configured (e.g., programmed) to operate the pump. In another embodiment, the reservoir is appropriately elevated (e.g., above the storage pods 10) such the rain water stored in the reservoir moves into the storage pods under the influence of gravity. In this embodiment, the moisture controller can operate one or more selectively actuatable valves to control the amount of rain water (e.g., moisture) delivered to the interior 14 of the storage pod 10. In other embodiments, the mausoleum 100 may receive water from a water supply line (e.g., water utility line) to supply water to the storage pod 10 if the mausoleum does not include a rain water collector/reservoir or if not enough rain water can be collected by the rain water collector to supply the storage pod(s) 10.

The housing 12 of the storage pod 10 can be made from both plastic and metal materials. In the preferred embodiment, all the surfaces defining the interior 14 of the storage pod 10 are plastic, such as plastic that is approximately 1.2 inches (30 mm) thick. The decomposition material DM is highly corrosive to metal and, therefore, any portion of the storage pod 10 that comes into contact with the decomposition material must be made of plastic or any other suitable material resistant to the corrosive effects of the decomposition material. In the preferred embodiment, the top and bottom portions 16, 18, and the end caps 30 are made of plastic and the clamps 54 are made of metal, such as stainless steel. Other configurations are within the scope of the present disclosure. For example, in one embodiment, every component of the housing 12 (e.g., top and bottom portions 16, 18, end caps 30, and clamps 54) are made of plastic.

To decompose a body B in the storage pod 10, the bottom portion 18 of the housing 12 is partially filled with an initial layer of decomposition material DM. The body B is then laid down on top of this initial layer of decomposition material DM (e.g., the interior 14). The bottom portion 18 is then completely filled with decomposition material DM which surrounds and covers the body B. The flanges 28 on either side of the bottom portion 18 help keep the decomposition material DM within the interior 14. At this time, if desired, the bottom portion 18 may be placed in the viewing table (e.g., the frame 68) such that the deceased may be viewed during a funeral event, as may be customarily done. When the bottom portion 18 is placed in the viewing table for the funeral event, the lower portion 34 of each end cap 30 (or some other component) may be attached to the opposite ends of the bottom portion to help retain the decomposition material DM within. For the same reasons, this may also be done before the bottom portion 18 is filled with decomposition material DM. After such an event (or at the desired time) the remaining components of the housing 12 are joined together to close the interior 14. The top portion 16 of the housing 12 is positioned over the bottom portion 18 such that the opposite lower edge margins 21 of the top portion each engage one of the opposite upper edge margins 26 of the bottom portion. The flanges 28 extending from the bottom portion 18 facilitate the positioning and retention of the top portion 16 on the bottom portion.

A remainder of the end caps 30 and clamps 54 are then attached to the top and bottom portions 16, 18. The clamps 54 may be slid over the top and bottom portions 16, 18 or the upper and lower clamp rings 56, 58 may be disconnected to position the clamps over the top and bottom portions. The fasteners 52 are then used to secure the upper and lower clamp rings 56, 58 together and clamping the top and bottom portions 16, 18 of the housing 12 together. Similarly, the remainder of the end caps 30 (i.e., upper portions 32) may be attached to the ends of the top and bottom portions 16, 18 of the housing 12. The fasteners 52 are then used to secure the upper and lower portions 32, 34 of the end caps 30 together. Additional fasteners 76, which may be the same or different than the fasteners described above, are then threaded into a corresponding opening in the upper and lower clamp rings 38, 44 to engage the top and bottom portions 16, 18 (e.g., the outside surface, a corresponding threaded hole, etc.) to secure each end cap 30 to the top and bottom portions. In other embodiments, other ways of securing each end cap 30 to the top and bottom portions 16, 18 may be used. When the end caps 30 are coupled to the top and bottom portions 16, 18, the end walls 36, 42 engage the ends of the top and bottom portions and the upper and lower clamp rings 38, 44 of the end cap overlie the outside surfaces of the top and bottom portions. Each end cap 30 forms a seal with the top and bottom portions 16, 18 that prevents the decomposition material DM from passing there-through. Additionally, each end cap 30 also serves to clamp (like clamps 54) the ends of the top and bottom portions 16, 18 together.

After each component of the housing 12 is assembled and the interior 14 enclosed (e.g., the housing is closed), the remaining empty space in the interior is filled with decomposition material DM. When the housing 12 is assembled, the product inlet 50 is in fluid communication with the interior 14 such that the decomposition material DM can enter the interior through the product inlet. In the preferred embodiment, the end of a hose is inserted into the product inlet 50 of at least one of the end caps 30 so that the decomposition material DM can be blown through the hose and into the interior 14. Other ways of filling the interior 14 with decomposition material DM are within the scope of the present disclosure. For example, the top portion 16 may include a door (not shown) which can be used to fill the interior 14 with decomposition material DM.

Once the storage pod 10 is filled with decomposition material DM, the storage pod can be moved to the mausoleum 100 (or any other suitable area) and stored while the decomposition material decomposes the body B. In the preferred embodiment, once the storage pod 10 is in the mausoleum 100, the moisture control unit 69, temperature monitor unit 67, air flow control unit 71 and prime mover 75 are all connected to the storage pod (if not already connected). During the decomposition process, the air vents 48 are in fluid communication with in the interior 14. The air vents 48 are configured to provide continuous fluid communication to the interior 48 such that air can freely flow into and out of the interior during the decomposition process. The flow of air into and out of the interior 14 facilitates the growth of the bacteria and the decomposition of the body B therein. As the moisture contained within the interior 14 is consumed by the bacteria or evaporates with the flow of air (as detected by the moisture sensor), additional moisture is periodically added to the interior by the moisture control unit 69 to maintain the optimal conditions for the bacteria growing therein. Similarly, during the decomposition process, the air flow control unit 71 and/or the moisture control unit 69 maintains the temperature of the interior (as detected by the temperature sensor) in the desired range. Moreover, as described above, the prime mover 75 can be operated to agitate the decomposition material DM and body B during the decomposition process. Typically, the period of time needed for the decomposition material DM to decompose the body B (e.g., the decomposition process or period of decomposition) is within about 24 months but may take as long as 36 months. This period of time generally corresponds to periodic agitation by the prime mover 75 and optimal conditions in the interior 14 being maintained by the moisture control unit 69 and/or air flow control unit 71. It is understood, that other factors, such as, but not limited to, the type of decomposition material DM and/or size of the body B, can vary the amount of time required for the body to decompose as well. After waiting the required period of time for the decomposition material DM to decompose the body B, the components of the housing 12 (e.g., end caps 30, clamps 54, top and bottom portions 16, 18) are disassembled and the remaining material (e.g., the decomposed body and remaining decomposition material) is collected and disposed of—such as by scattering. The ability to disassemble the housing 12 facilitates the removal and collection of the remaining material from the storage pod 10.

Referring to FIGS. 9-14, another embodiment of a storage pod of the present disclosure is generally indicated at 110. Storage pod 110 is similar to storage pod 10 and, thus, for ease of comprehension, where similar or analogous elements are used, reference numerals "100" units higher are employed. As with storage pod 10, storage pod 110 holds and stores a body B as the body is decomposed by the decomposition material DM.

Figure 11:
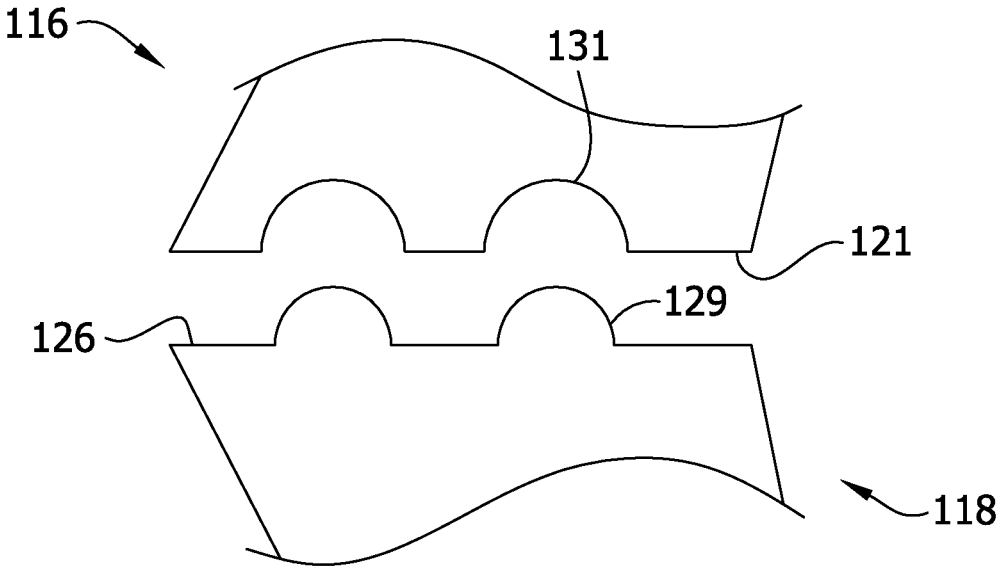
FIG. 11 is an enlarged fragmentary cross section of the connection between the top and bottom portions of the storage pod.

The storage pod 110 includes an elongate housing 112 with opposite ends and a length L1 extending between the opposite ends. The housing 112 defines an interior 114 configured to receive the body B and decomposition material DM. The housing 112 includes a top portion 116 and a bottom portion 118 that define the interior 114. The top and bottom portions 116, 118 are releasably connected to one another to provide access to the interior 114. In this embodiment, clasps or latches 154 (broadly, one or more clasps) on the sides of the top and bottom portions 116, 118 are used to secure the top and bottom portions together. In the illustrated embodiment, the housing 112 has a polygonal cross-sectional shape. Specifically, the housing 112 has a hexagonal cross-sectional shape. However, other shapes of the housing 112 are within the scope of the present disclosure. The top portion 116 defines the upper half of the housing 112 and the bottom portion 118 defines the lower half of the housing. The top portion 116 includes an upper wall 117, opposite side walls 119 extending downward from opposite sides of the upper wall and opposite end walls 129 extending downward from opposite ends of the upper wall and between the side walls. The side walls 119 taper outward, away from one another as they extend downward. Similarly, the bottom portion 118 includes a lower wall 123, opposite side walls 125 extending upward from opposite sides of the lower wall and opposite end walls 127 extending upward from opposite ends of the lower wall and between the side walls. The side walls 125 taper outward, away from one another as they extend upward. In this embodiment, the end walls 127, 129 define the ends of the housing 112. When the top and bottom portions 116, 118 are connected together (e.g., the housing 112 is closed), the lower perimeter edge margin 121 of the top portion 116 engages with the corresponding upper perimeter edge margin 126 of the bottom portion 118. As shown in FIG. 11, the upper perimeter edge margin 126 of the bottom portion 118 and lower perimeter edge margin 121 of the top portion 116 may include sealing structure, such as tongues 129 and grooves 131 (broadly, at least one tongue and groove) which mate with one another, to create a seal that prevents the decomposition material DM from passing there-through. The tongues 129 and grooves 131 may extend around the entire perimeter edge margins 126, 121. In one embodiment, a sealant, such as silicone, may be use with the tongue 129 and groove 131 to facilitate the formation of the seal.

Figure 9:
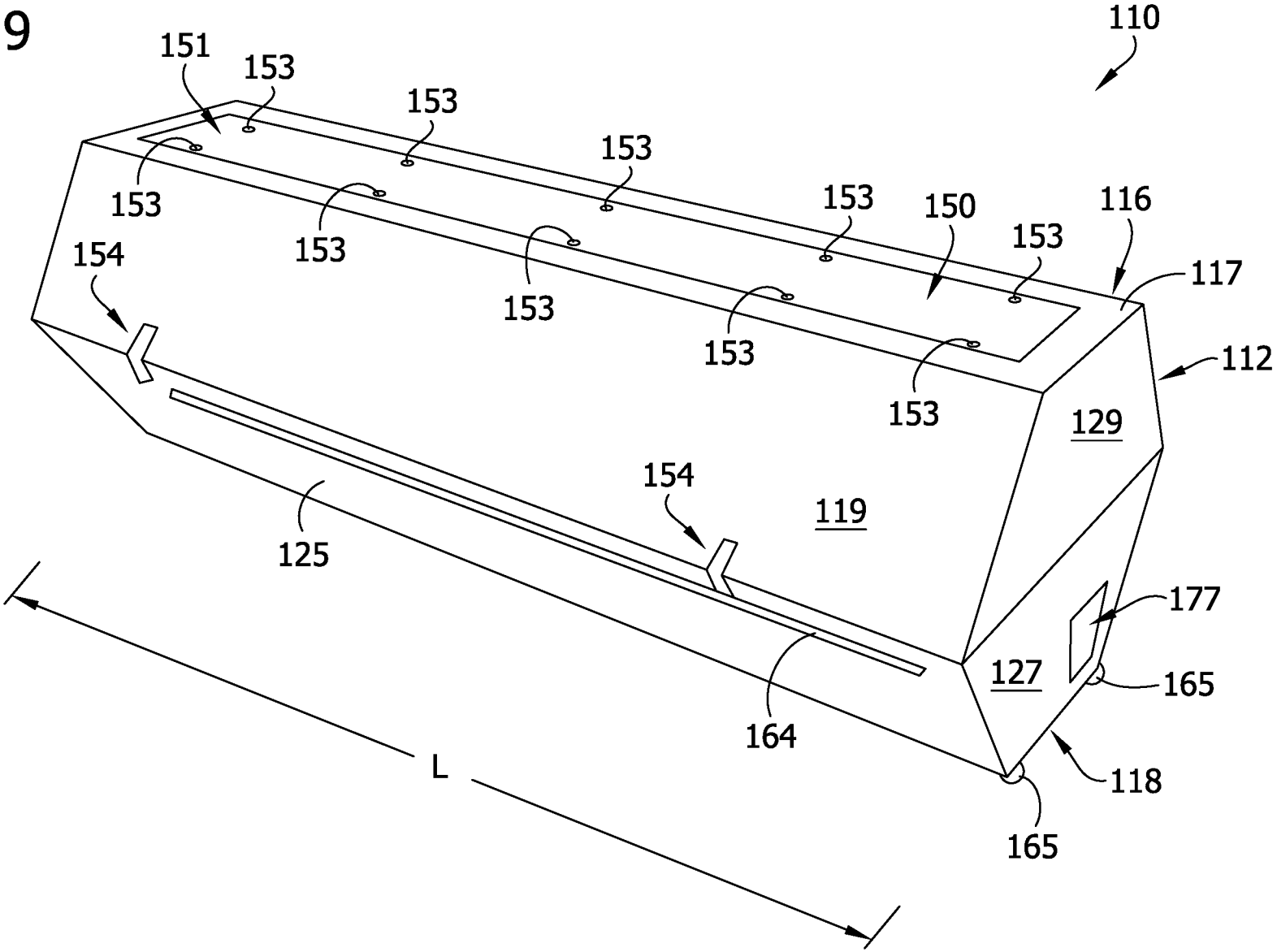
FIG. 9 is a perspective of a storage pod according to another embodiment of the present disclosure.

Referring to FIG. 9, the top portion 116 defines a product inlet 150 to facilitate the filling of the interior 114 with the decomposition material DM when the housing 112 is closed. The product inlet 150 is an opening that extends through the upper wall 117. In the illustrated embodiment, the product inlet 150 is a rectangular shaped opening extending over most of the length of the upper wall 117. Other configurations are within the scope of the present disclosure. A lid 151 is shown covering and closing the product inlet 150. Fasteners 153, such as screws, may be used to secure the lid 151 to the upper wall 117. The lid 151 preferably forms a fluid tight seal with the top portion 116. The bottom portion 118 may include a handle or rail 164 extending along each side wall 125 for several persons to grab in order to transport the housing 112. In one embodiment the handle 164 may be integrally formed with the bottom portion 118. The bottom portion 118 may also include one or more skids 165 on the lower wall 123.

Figure 10:
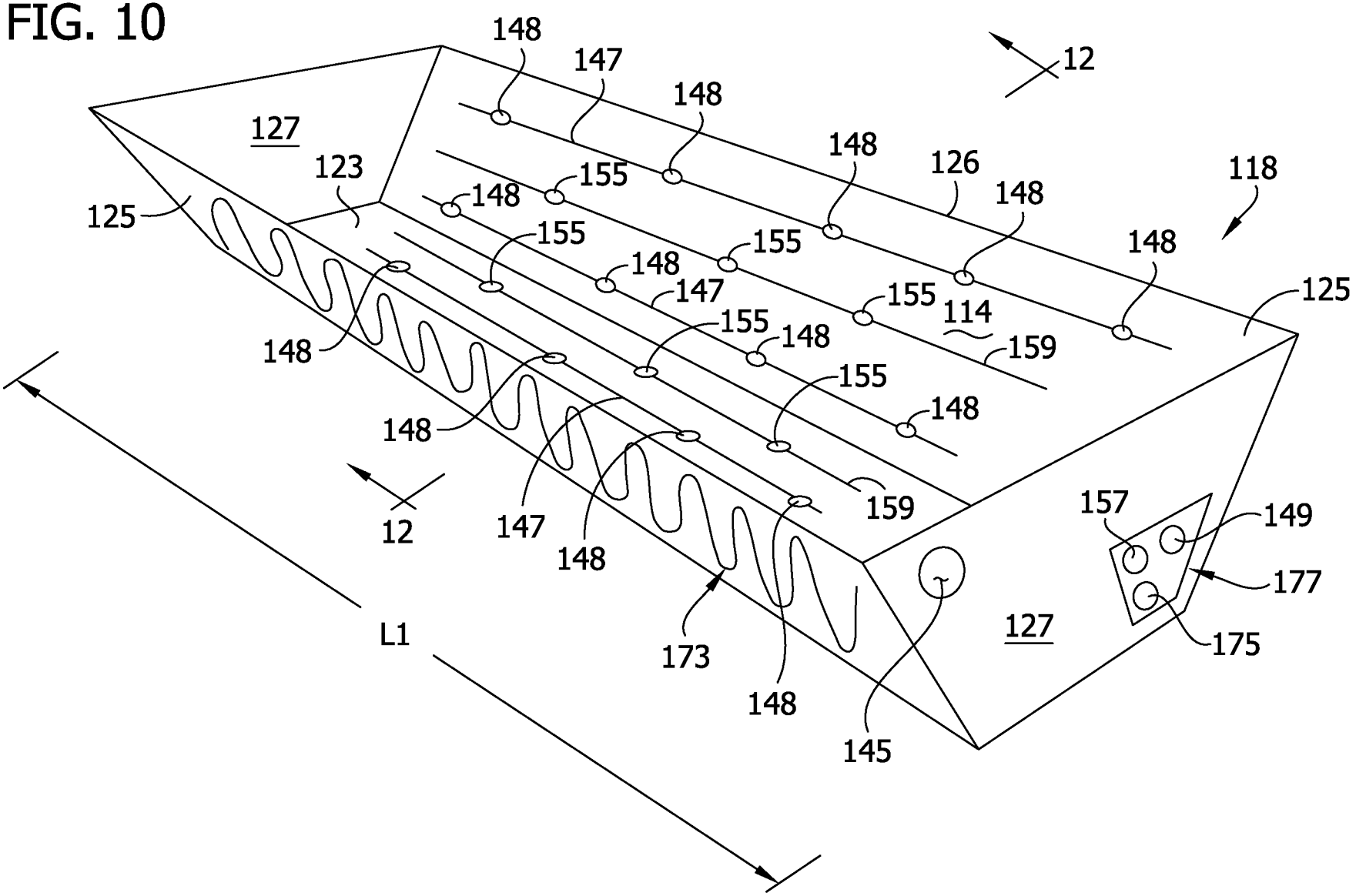
FIG. 10 is a perspective of a bottom portion of the storage pod.
Figure 12:
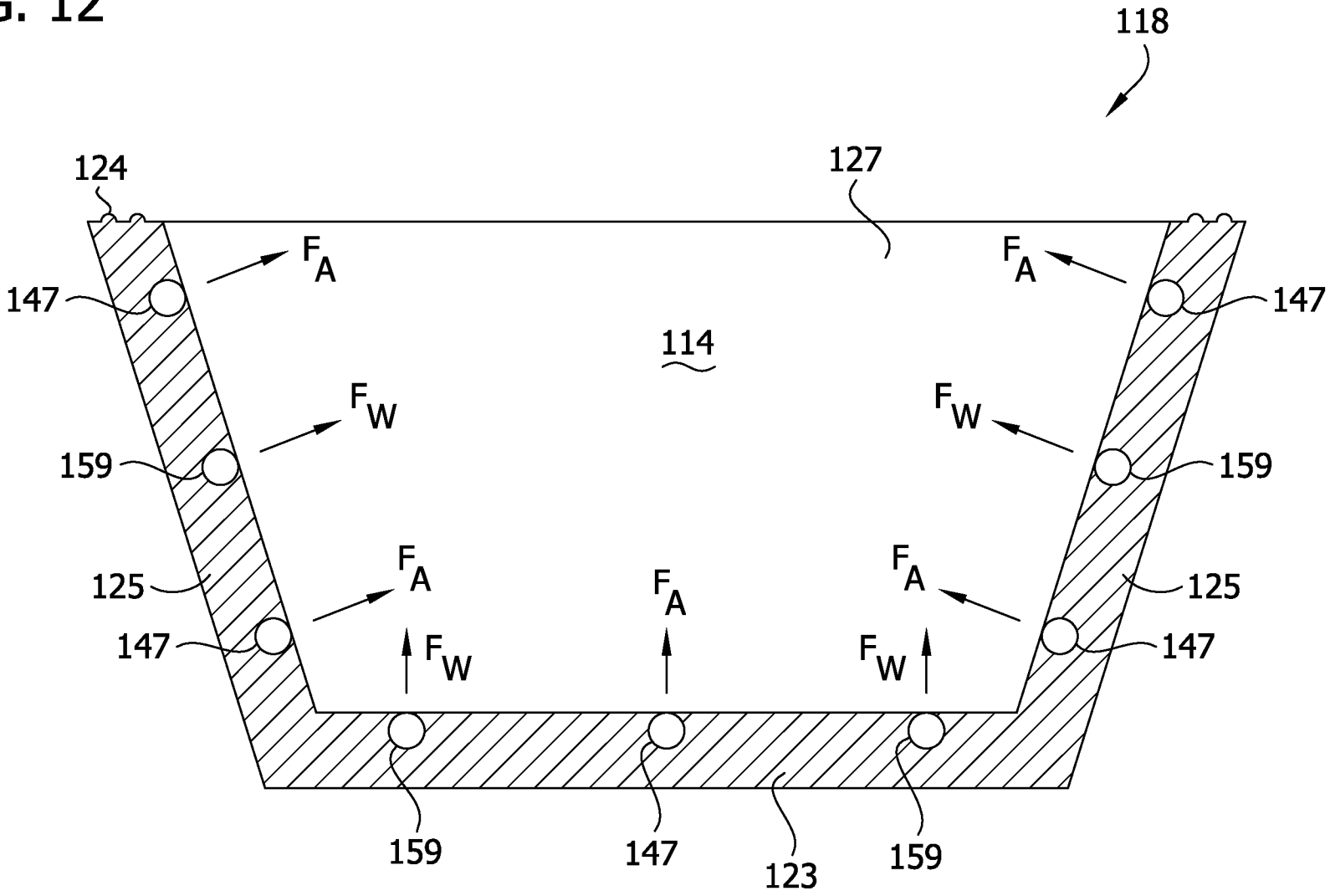
FIG. 12 is a cross-section of the bottom portion of the storage pod taken through line 12-12 of FIG. 10.

Referring to FIGS. 10 and 12, the bottom portion 118 of the housing 112 includes a plurality (broadly, at least one) of individual air vents 148 (e.g., air outlets). Each air vent 148 directs or supplies air to the interior 114 as the body decomposes in the closed housing 112, as discussed in more detail below. In this embodiment, the bottom portion 118 of the housing 112 includes an air inlet 149 configured to connect to an air supply system (not shown), such as a fan or air compressor, that supplies the air to the interior 114 via the air vents 148. One or more manifolds and/or ducts 147 fluidly connect each air vent 148 with the air inlet 149. In this embodiment, the manifolds and/or ducts are disposed (e.g., embedded) within the lower wall 123, side walls 125 and at least one end wall 127 of the bottom portion 118. The air vents 148 may be openings in the ducts 147 or nozzles connected to the ducts. Each air vent 148 directs the air supplied by the air supply system into the interior 114. In the illustrated embodiment, the air vents 148 direct the air in a direction $F_A$ generally towards the center of the interior 114. As explained in more detail below, the air supplied to the air vents 148 is used by bacteria to decompose the body B and to agitate the body and decomposing material DM while the body is decomposing. In the illustrated embodiment, the air vents 148 are arranged on the lower wall 123 and side walls 125. Other configurations are within the scope of the present disclosure. In this embodiment, the housing 112 includes a gas vent 145 (e.g., a vent connection, a gas relief valve), to allow excess air to escape the interior 114 when the housing is closed, as well as gasses that build up in the interior during the decomposition process. The gas vent 148 may be coupled to a gas collection system (not shown) that collects, stores and/or processes the excess air/gas from the storage pod 110 or the gas vent 148 may discharge the excess air/gas into the atmosphere. In this embodiment, the storage pod 110 preferably includes an air flow control unit (not shown), as described above, to regulate the amount of air delivered to the interior 114 via the fluid vents 148. The storage pod 110 may also include a gas sensor (not shown) configured to sense the amount of air and gas coming out of the interior 114, via the gas vent 145, and/or what is the composition (e.g., types of gasses, such as methane) of the air and gas coming out the interior.

In this embodiment, the bottom portion 118 of the housing 112 also includes a plurality (broadly, at least one) of individual fluid vents 155 (e.g., fluid outlets). Each fluid vent 155 directs or supplies fluid, such as water, to the interior 114 as the body decomposes in the closed housing 112, as discussed in more detail below. In this embodiment, the bottom portion 118 of the housing 112 includes a fluid inlet 157 configured to connect to a fluid supply system (not shown), such as a water utility pipe, that supplies the fluid to the interior 114 via the fluid vents 155. One or more manifolds and/or ducts 159 fluidly connect each fluid vent 155 with the fluid inlet 157. In this embodiment, the manifolds and/or ducts 159 are disposed (e.g., embedded) within the lower wall 123, side walls 125 and at least one end wall 127 of the bottom portion 118. The fluid vents 155 may be openings in the ducts 159 or nozzles connected to the ducts. Each fluid vent 155 directs the fluid supplied by the fluid supply system into the interior 114. In the illustrated embodiment, the fluid vents 155 direct the fluid in a direction $F_W$ generally towards the center of the interior 114. The fluid supplied to the fluid vents 155 is used by bacteria to decompose the body B, as described above. In the illustrated embodiment, the fluid vents 155 are arranged on the lower wall 123 and side walls 125. Other configurations are within the scope of the present disclosure. In this embodiment, the housing 112 may include a drain (not shown), to allow excess fluid to flow from the interior 114 when the housing 112 is closed. In this embodiment, the storage pod 110 preferably includes a moisture control unit (not shown), as described above, to regulate the amount of moisture (e.g., the amount of fluid, such as water) in the interior 114 and entering the interior via the fluid vents 155.

In this embodiment, the bottom portion 118 of the housing 112 also includes at least one heating coil 173, such as an electric heating coil, configured to heat the interior 114 as the body decomposes in the closed housing 112, as discussed in more detail below. In this embodiment, the bottom portion 118 of the housing 112 includes an electrical outlet 175 to connect to a power source (not shown) to power the electric heating coil 173. In the illustrated embodiment, the heating coil 173 is disposed (e.g., embedded) within the lower walls 123 and side walls 125. Other configurations are within the scope of the present disclosure. In this embodiment, the storage pod 110 preferably includes a temperature monitor unit (not shown), as described above, with a temperature module (e.g., controller) further configured to activate the heating coil 173 in response to the sensed temperature to selectively or continuously heat the interior 114 to a selected temperature. The electrical outlet 175, fluid inlet 157 and air inlet 149 may all be located within a control console 177 on the bottom portion 118. Moreover, it is understood the top portion 116, like the bottom portion 118, may also include one or more of the air vents 148, fluid vents 155 and heating coil 173, with the associated components, as well. As mentioned above, preferably the top and bottom portions 116, 118 (e.g., lower, upper, side and end walls) are plastic, such as plastic that is approximately 1.2 inches (30 mm) thick.

Figure 13:
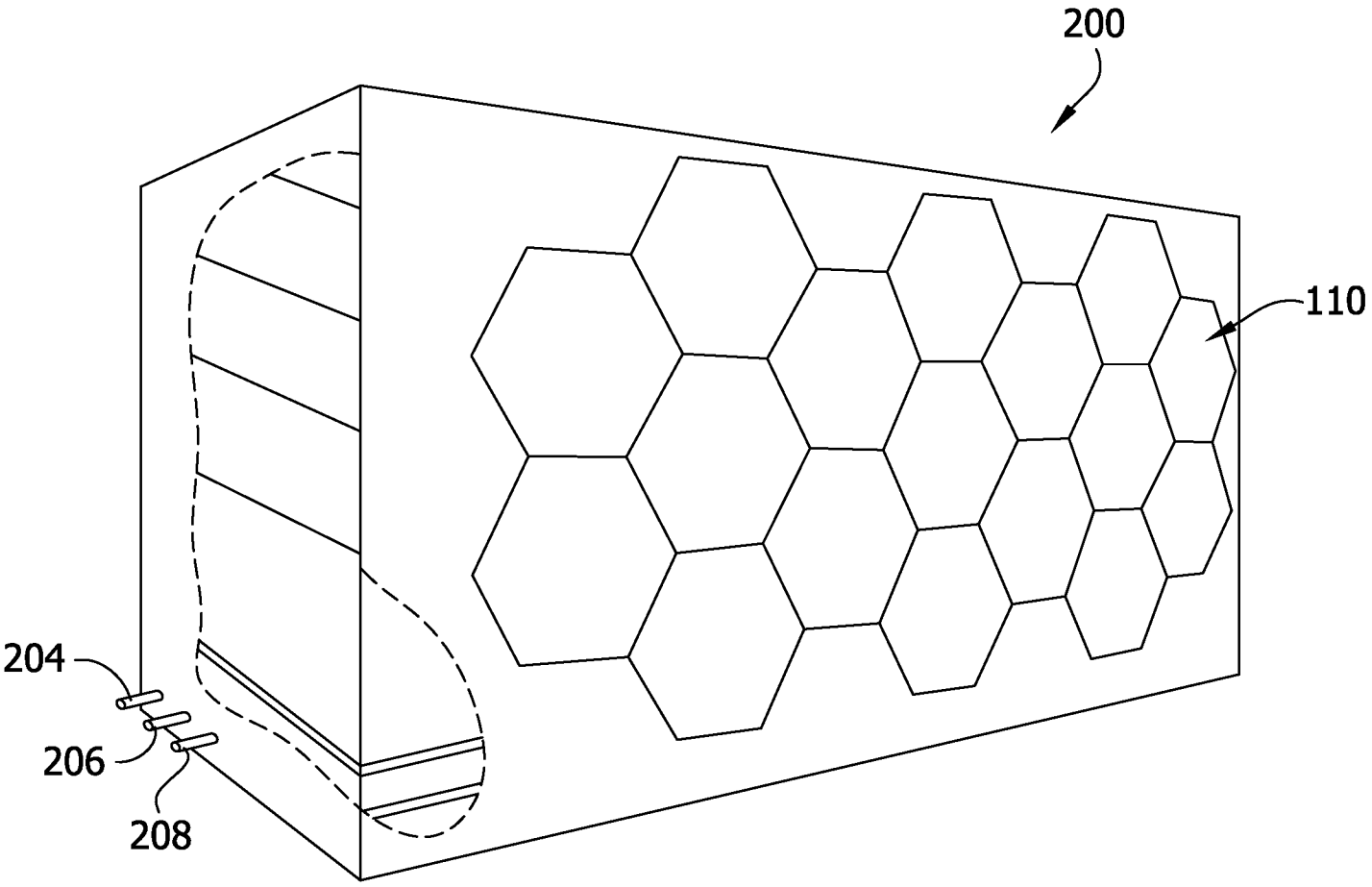
FIG. 13 is a perspective of a mausoleum that houses a plurality of storage pods of FIG. 9 according to another embodiment of the present disclosure.
Figure 14:
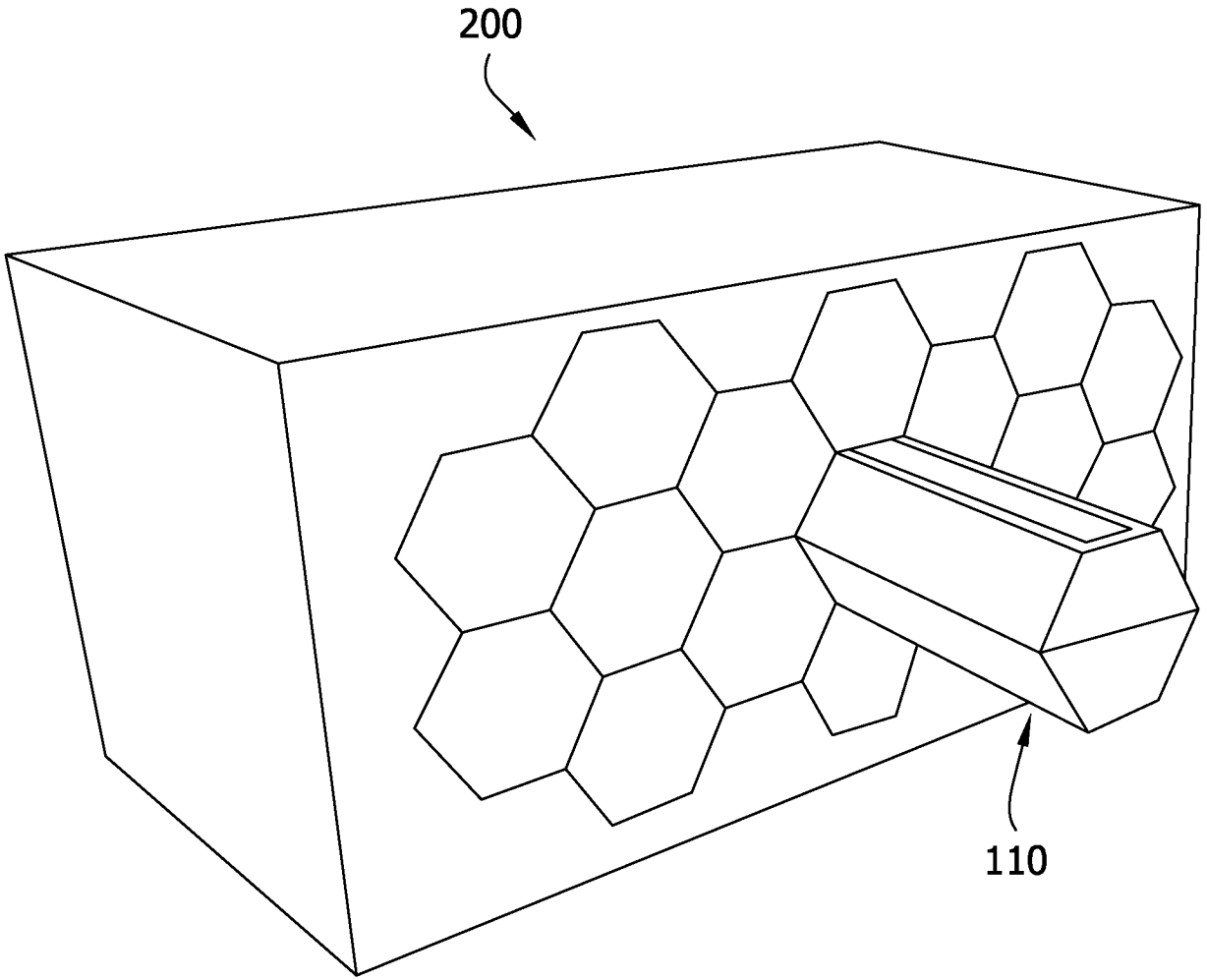
FIG. 14 is the same as FIG. 13 with one storage pod partially received in the mausoleum.

Referring to FIGS. 13 and 14, a mausoleum (e.g. a structure) for holding one or more storage pods 110 during the decomposition process is shown generally at 200. The storage pod 110 of the present disclosure could also be housed in a funeral home, cemetery, or other facility. As shown in the illustrated embodiment, the mausoleum 200 houses a frame which supports a plurality of storage pods 110. In this embodiment, the frame has a honeycomb structure, corresponding to the hexagonal cross-sectional shape of the storage pods 110, to house the storage pods. Other configurations are within the scope of the present disclosure. It is understood the mausoleum 200 and corresponding support structure (e.g., the frame) can be configured to house any number of storage pods 110 (broadly, one or more storage pods). In the illustrated embodiment, the mausoleum 200 includes a central fluid supply line 204 (e.g., pipe) that is connected to the fluid supply system (not shown) and to each storage pod 110 to fluidly connect each storage pod housed in the mausoleum to the fluid supply system. Likewise, the mausoleum 200 includes a central air supply line 206 that is connected to the air supply system (not shown) and to each storage pod 110 to fluidly connect each storage pod housed in the mausoleum to the air supply system. The mausoleum 200 also includes a central power supply line 208 (e.g., electrical cable) that is connected to the power source and to each storage pod 110 to electrically power each storage pod housed in the mausoleum. The mausoleum 200 may also include solar cells and a rain water collector with a reservoir, as described above.

To decompose a body B in the storage pod 110, the bottom portion 118 of the housing 112 is partially filled with an initial layer of decomposition material DM. The body B is then laid down in the interior 14 on top of this initial layer of decomposition material DM. The bottom portion 118 may then be completely filled with decomposition material DM which surrounds and covers the body B. At this time, if desired, the bottom portion 18 may be placed in the viewing table such that the deceased may be viewed during a funeral event, as may be customarily done. After such an event (or at the desired time), the housing 112 is closed by positioning the top portion 116 of the housing over the bottom portion 118. The tongue 129 and grooves 131 in the perimeter edge margins 126, 121 mate to from a seal between the top and bottom portions 116, 118. The latches 154 are closed to secure the top and bottom portions 116, 118 together. The remaining empty space in the interior 114 is filled with decomposition material DM by removing the lid 151 from the product inlet 150 and placing the decomposition material in the interior via the product inlet. The lid 151 is then re-secured to the top portion 116.

Once the storage pod 110 is filled with decomposition material DM, the storage pod can be moved to the mausoleum 200 (or any other suitable area) and stored while the decomposition material decomposes the body B. Once the storage pod 110 is in the mausoleum 200, the storage pod is connected to the fluid supply system, via the fluid inlet 157, the air supply system, via the air inlet 147, and the power source via the electrical outlet 175. During the decomposition process, the air vents 148 deliver air, which may be periodically or continuously, from the air supply source to the interior 114. The flow of air facilitates the growth of the bacteria and the decomposition of the body B therein. In addition, the flow of air may be used to agitate (e.g., move) the body B and decomposition material DM within the interior 114. For example, streams of pressurized air directed into the interior via the air vents 148 may be used for agitation. In this embodiment, the storage pod 110 may or may not include a prime mover, as described above, to agitate the body B and decomposition material DM in combination with the air. Likewise, during decomposition, fluid (e.g., water) is added, continuously or intermittently, to the interior 114 via the fluid vents 155. The flow of air into and out of the housing 112, via the air vents 148 and gas vent 145, generally keeps the temperature of the housing a constant temperature, which is suitable for the bacteria. Accordingly, typically no heating or cooling of the housing 112 is needed during decomposition. However, when the housing 112 is stored in cooler temperatures, such as outside in a colder climate, the heating coil 173 may be activated to raise the temperature of the interior and incubate the bacteria growing therein. The heating coil 173 may be used until the bacteria, which generate heat as they decompose the body B, generate a sufficient amount of heat themselves. After waiting the required period of time for the decomposition material DM to decompose the body B, the components of the top and bottom portions 116, 118 are disassembled and the remaining material (e.g., the decomposed body and remaining decomposition material) is collected and disposed of—such as by scattering.

Figure 15:
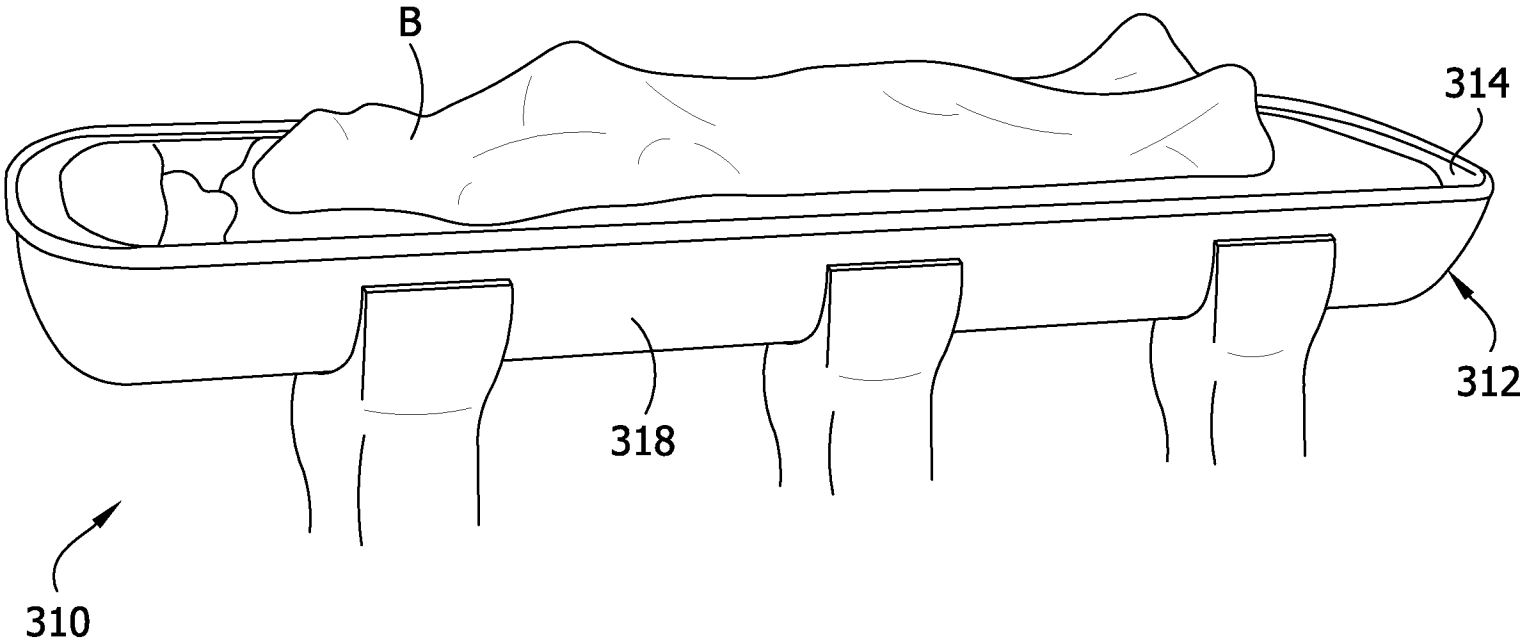
FIG. 15 is a perspective of a storage pod according to another embodiment of the present disclosure showing a top portion of the pod removed, a bottom portion filled with decomposition material, and a body resting on the decomposition material.
Figure 16:
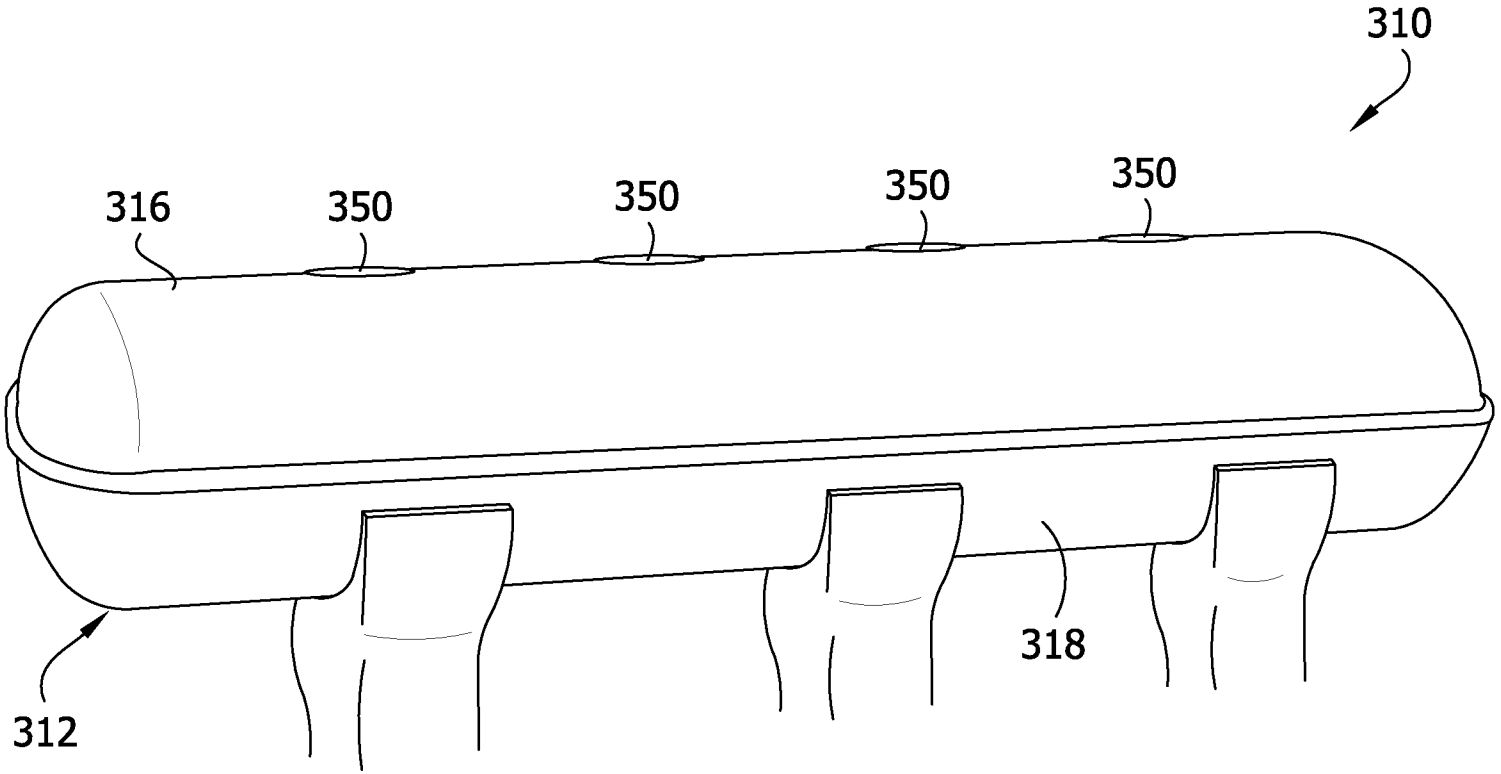
FIG. 16 is a perspective of the storage pod of FIG. 15 with the top portion placed on the bottom portion.
Figure 17:
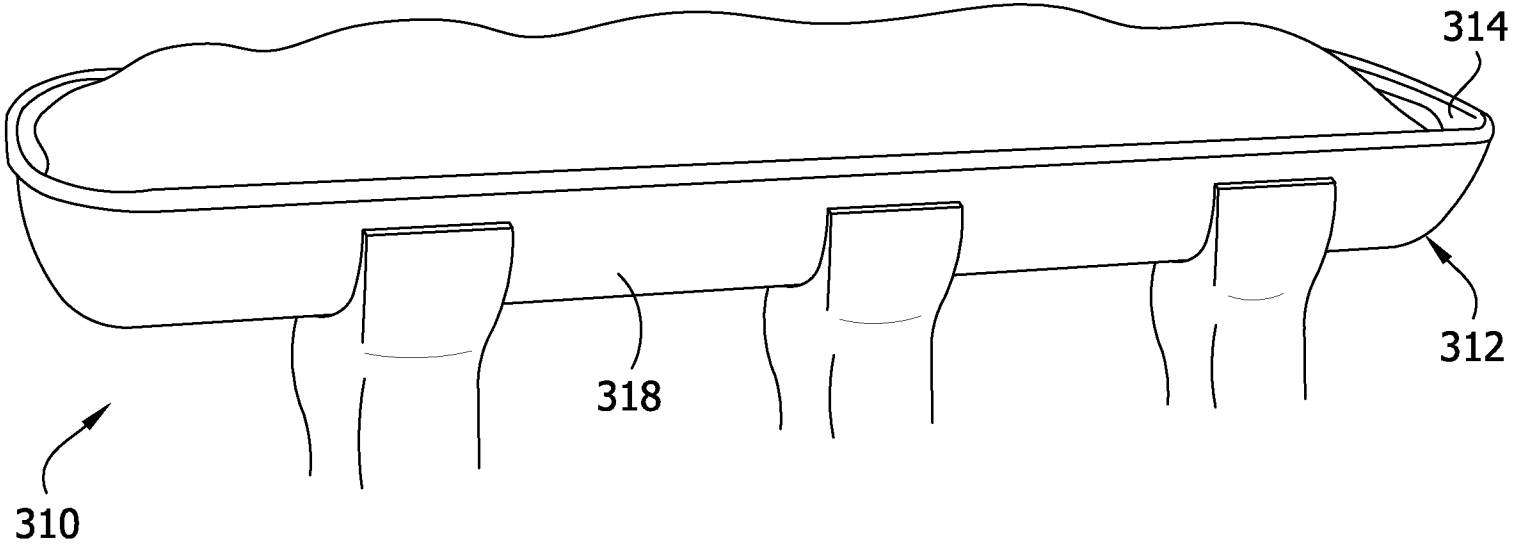
FIG. 17 is a perspective of the storage pod of FIG. 15 showing the pod filled with decomposition material after the material has decomposed the body.

Referring to FIGS. 15-17, another embodiment of a storage pod of the present disclosure is generally indicated at 310. Storage pod 310 is similar to storage pod 10 and, thus, for ease of comprehension, where similar or analogous elements are used, reference numerals "300" units higher are employed. As with storage pod 10, storage pod 310 holds and stores a body B as the body is decomposed by the decomposition material DM.

The storage pod 310 includes an elongate housing 312. The housing 312 defines an interior 314 configured to receive the body B and decomposition material DM. The housing 312 includes a top portion 316 and a bottom portion 318 that define the interior 314. The top and bottom portions 316, 318 are releasably connected to one another to provide access to the interior 314. In the illustrated embodiment, the housing 312 has a generally cylindrical shape with a generally elliptical shape in cross-section. However, other shapes of the housing 312 are within the scope of the present disclosure. The top portion 316 defines the upper half of the housing 312 and the bottom portion 318 defines the lower half of the housing.

Referring to FIG. 16, the top portion 316 defines a plurality of product inlets 350 to facilitate the filling of the interior 314 with the decomposition material DM when the housing 312 is closed. The product inlets 350 are openings that extend through a top of the top portion 316 of the housing 312. In the illustrated embodiment, the product inlets 350 are circular shaped opening comprising a total of four (4) openings. Other configurations are within the scope of the present disclosure. FIG. 17 shows the storage pod 310 with the top portion 316 removed after the decomposition material DM has decomposed the body B. In one embodiment, the pod 310 is reusable.

It is apparent that the elements, features, and/or teachings set forth in each embodiment disclosed herein are not limited to the specific embodiment(s) the elements, features and/or teachings are described in. Accordingly, it is understood that the elements, features and/or teachings described in one embodiment may be applied to one or more of the other embodiments disclosed herein.

When introducing elements of aspects of the invention or the examples and embodiments thereof, the articles "a," "an," "the," and "said" are intended to mean that there are one or more of the elements. The terms "comprising," "including," and "having" are intended to be inclusive and mean that there may be additional elements other than the listed elements.

In view of the above, it will be seen that several advantages of the invention are achieved and other advantageous results attained.

Not all of the depicted components illustrated or described may be required. In addition, some implementations and embodiments may include additional components. Variations in the arrangement and type of the components may be made without departing from the spirit or scope of the claims as set forth herein. Additional, different or fewer components may be provided and components may be combined. Alternatively or in addition, a component may be implemented by several components.

The above description illustrates the invention by way of example and not by way of limitation. This description enables one skilled in the art to make and use the invention, and describes several examples, embodiments, adaptations, variations, alternatives and uses of the invention. Additionally, it is to be understood that the invention is not limited in its application to the details of construction and the arrangement of components set forth in the following description or illustrated in the drawings. The invention is capable of other embodiments and of being practiced or carried out in various ways. Also, it will be understood that the phraseology and terminology used herein is for the purpose of description and should not be regarded as limiting.

Having described aspects of the invention in detail, it will be apparent that modifications and variations are possible without departing from the scope of aspects of the invention as defined in the appended claims. It is contemplated that various changes could be made in the above constructions, products, and methods without departing from the scope of aspects of the invention. In the preceding specification, various examples and embodiments have been described with reference to the accompanying drawings. It will, however, be evident that various modifications and changes may be made thereto, and additional embodiments may be implemented, without departing from the broader scope of the invention as set forth in the claims that follow. The specification and drawings are accordingly to be regarded in an illustrative rather than restrictive sense.

OTHER STATEMENTS OF THE INVENTION

The following are statements of invention described in the present application. Although some of the following statements are not currently presented as claims, the statements are believed to be patentable and may subsequently be presented as claims. Associated methods corresponding to statements of apparatus or systems below, are also believed to be patentable and may subsequently be presented as claims. It is understood that the following statements may refer to and be supported by one, more than one or all of the embodiments described above.

A1. A storage pod for containing a body and decomposition material for decomposing the body in the storage pod, the storage pod comprising: an elongate housing having opposite ends, the housing configured to contain the body and the decomposition material, the housing defining: an interior configured to receive the body and decomposition material; at least one air inlet in fluid communication with the interior, the at least one air inlet configured to provide continuous fluid communication to the interior such that air can freely flow into and out of the interior when the housing is closed; and at least one product inlet in fluid communication with the interior such that decomposition material can enter the interior through the at least one product inlet when the housing is closed.

A2. The storage pod of feature A1, wherein the housing further includes a top portion and a bottom portion, the top and bottom portions at least partially defining the interior and being releasably connected to one another to provide access to the interior.

A3. The storage pod of feature A2, wherein the housing further includes opposite end caps at each end of the housing, each end cap defining a closed end to the interior.

A4. The storage pod of feature A3, wherein each end cap is releasably connected to the top and bottom portions.

A5. The storage pod of feature A3, wherein one of the end caps defines the at least one product inlet.

A6. The storage pod of feature A3, wherein one of the end caps defines the at least one air inlet.

A7. The storage pod of feature A6, wherein said one of the end caps defines a plurality of individual air inlet holes.

A8. The storage pod of feature A2, wherein the housing further includes a plurality of releasable clamps, the clamps configured to secure the top and bottom portions together.

A9. The storage pod of feature A8, wherein each clamp extends circumferentially around the top and bottom portions.

A10. The storage pod of feature A1, wherein the housing has an elliptical cross-sectional shape.

A11. The storage pod of feature A1, further comprising an air flow control unit configured to regulate the amount of supplied air to the interior.

A12. The storage pod of feature A11, further comprising a moisture control unit configured to regulate the amount of moisture in the interior.

A13. The storage pod of feature A12, wherein the combination of the air flow control unit and moisture control unit maintain the temperature of the interior between about 60° F. (15° C.) and about 90° F. (32° C.).

A14. The storage pod of feature A1, further comprising a vibrator attached to the housing for vibrating the housing to agitate the body and decomposition material in the housing.

A15. The storage pod of feature A1, in combination with a frame, the frame being configured to support the storage pod.

A16. The storage pod of feature A15, further comprising a driver operatively coupled to the storage pod, the driver configured to move the storage pod relative to the frame when the storage pod is supported by the frame.

A17. The storage pod of feature A16, in combination with a power source configured to power the driver.

A18. The storage pod of feature A17, wherein the power source comprises at last one solar cell.

A19. The storage pod of feature A15, in combination with a water supply system configured to supply water to the interior of the housing.

A20. The storage pod of feature A19, wherein the water supply system comprises a rain water collector and a reservoir fluidly connected to the rain water collector, the rain water collector configured to collect rain water and the reservoir configured to store the collected rain water.

A21. The storage pod of feature A1, wherein the housing is plastic.

A22. A storage pod system including the storage pod of feature A1, the system comprising a plurality of storage pods, and a frame supporting the storage pods.

B1. A method of decomposing a body, the method comprising: placing the body into an interior of a housing; filling the interior with a decomposition material; waiting for the body to decompose; and simultaneously, with said waiting, permitting air flow into and out of the interior through at least one air inlet defined by the housing.

B2. The method of claim B1 further comprising maintaining a temperature of the interior between about 60° F. (15° C.) and about 90° F. (32° C.).

B3. The method of claim B1 further comprising vibrating the housing to agitate the body and decomposition material in the housing.

B4. The method of claim B1 further comprising regulating a moisture level in the interior of the housing.

B5. The method of claim B4 further comprising directing water into the interior of the housing to regulate the amount of moisture in the housing.

What is claimed is:

1. A storage pod for containing a body and decomposition material for decomposing the body in the storage pod, the storage pod comprising:

an elongate housing having opposite ends and a longitudinal axis extending between the opposite ends, the housing configured to contain the body and the decomposition material, the housing defining an interior configured to receive the body and the decomposition material;

at least one air vent in fluid communication with the interior such that air can enter the interior through the at least one air vent when the housing is closed; and a product inlet in fluid communication with the interior such that the decomposition material can enter the interior through the product inlet when the housing is closed; and a prime mover operatively connected to the housing for moving the housing to agitate the body and decomposition material in the housing to mix the decomposition material with the body for decomposing the body, wherein the prime mover comprises a driver which rotates the housing about the longitudinal axis of the housing.

2. The storage pod of claim 1, wherein the housing further includes a top portion and a bottom portion, the top and bottom portions at least partially defining the interior and being releasably connected to one another to provide access to the interior.

3. The storage pod of claim 2, wherein the housing further includes a plurality of releasable clamps, the clamps configured to secure the top and bottom portions together.

4. The storage pod of claim 1, further comprising an air flow control unit configured to regulate the amount of air supplied to the interior through the at least one air vent.

5. The storage pod of claim 1, in combination with an air supply system configured to supply air to the interior of the housing via the at least one air vent.

6. The storage pod of claim 1, further comprising at least one fluid vent in fluid communication with the interior such that a fluid can enter the interior through the at least one fluid vent.

7. The storage pod of claim 6, further comprising a moisture control unit configured to regulate the amount of fluid supplied to the interior through the at least one fluid vent.

8. The storage pod of claim 7, in combination with a fluid supply system configured to supply fluid to the interior of the housing via the at least one fluid vent.

9. The storage pod of claim 1, in combination with a frame, the frame being configured to support the storage pod.

10. The storage pod of claim 1, wherein the housing has a polygonal cross-sectional shape.

11. The storage pod of claim 1, wherein the housing has an elliptical cross-sectional shape.

12. The storage pod of claim 1, in combination with the decomposition material.

13. The storage pod of claim 1, further comprising at least one of a moisture sensor, a gas sensor or a temperature sensor.

14. The storage pod of claim 1, wherein the housing is made of plastic.

15. A storage pod system including the storage pod of claim 1, the system comprising a plurality of the storage pods, and a frame supporting the storage pods.

* * * * *